United States Patent [19]

Taki et al.

[11] Patent Number: 4,692,951

[45] Date of Patent: Sep. 15, 1987

[54] SANITARY FACILITY ROOM FOR CLEAN ROOM

[75] Inventors: Masaru Taki; Hiroshi Okada; Seijiro Kawamura; Akio Kusumoto; Koji Morita, all of Fukuoka; Takao Ikenaga, Kanagawa; Toshifumi Shigematsu, Kanagawa; Masami Iida, Kanagawa, all of Japan

[73] Assignee: Toto Ltd., Fukuoka, Japan

[21] Appl. No.: 791,155

[22] Filed: Oct. 24, 1985

[30] Foreign Application Priority Data

Oct. 31, 1984 [JP] Japan ..... 59-230852
Oct. 31, 1984 [JP] Japan ..... 59-230860

[51] Int. Cl.[4] ..... A47K 4/00; E03D 9/04

[52] U.S. Cl. ..... 4/664; 4/209 R; 4/213; 4/662

[58] Field of Search ..... 4/300, 304, 662, 213, 4/661, 214, 215, 209 FF, 209 R

[56] References Cited

U.S. PATENT DOCUMENTS

| | | | |
|---|---|---|---|
| 3,480,787 | 11/1969 | Johansen | 4/623 X |
| 3,484,477 | 1/1970 | Classen | 4/623 X |
| 3,491,381 | 1/1970 | Cathcart | 4/623 |
| 3,555,368 | 1/1971 | Atkins | 4/304 X |
| 3,576,277 | 4/1971 | Blackmon | 4/623 |
| 3,585,652 | 6/1971 | Forbes et al. | 4/304 X |
| 3,742,520 | 7/1973 | Bernardi | 4/662 |
| 3,747,129 | 7/1973 | Dyar | 4/662 |
| 3,755,826 | 9/1973 | Roberts | 4/662 |
| 4,017,916 | 4/1977 | Pearson | 4/213 |
| 4,031,574 | 6/1977 | Werner | 4/213 |
| 4,044,408 | 8/1977 | Pearson | 4/213 |
| 4,134,163 | 1/1979 | Matsunaga | 4/304 |
| 4,144,596 | 3/1979 | MacFarlane et al. | 4/626 |
| 4,145,769 | 3/1979 | MacFarlane et al. | 4/626 |
| 4,233,692 | 11/1980 | Sinsley | 4/664 X |
| 4,309,781 | 1/1982 | Lissau | 4/304 |

*Primary Examiner*—Henry K. Artis
*Attorney, Agent, or Firm*—Sandler & Greenblum

[57] ABSTRACT

This invention relates to a sanitary facility room to be installed in a computer room or a clean room found in a manufacturing factory for a semiconductor element wherein the water supplying means is operated by a control part received a sensed signal from the sensing means by a sensing operation of the sensing means for a human body, a cleaning water is supplied to the sanitary device to form water films at the inner surface of the sanitary device and to perform an automatic cleaning of the sanitary device.

31 Claims, 33 Drawing Figures

SANITARY FACILITY ROOM FOR CLEAN ROOM

BACKGROUND OF THE INVENTION

1. Field of the Invention

This invention relates to a sanitary facility room to be installed in a computer room or a clean room found in a semiconductor element manufacturing factory or the like.

2. Description of the Prior Art

In a conventional type of such clean room, a sanitary facility room having some sanitary equipment such as toilet bowls and hand washing bowls or the like installed therein was not arranged in the clean room, but installed outside of the clean room, so that its use was quite inconvenient.

The sanitary facility room was not mounted in the clean room because splashed stain water or adhered filth during use of sanitary facility generates dust after they become dried, or because manual operation of the plug during washing operation caused some hand stains to adhere to the operating part of the plug due to the relative by frequent operation of the plug, and because the hand stains might float in the sanitary facility room as dust, and at the same time odor or dust in the sanitary equipment stay in the air. Further, in case of the toilet bowl, a user uses toilet paper after utilizing the toilet bowl and in the case utilizing a hand washing bowl, the user might use a towel after its utilization, resulting in the generation of dusts from the toilet paper or towel or the like floated in the sanitary facility room and accumulated in it, and these dusts were adhered to the clothes of the user and brought into the clean room.

SUMMARY OF THE INVENTION

With the foregoing in mind, the present invention may accomplish the following objects.

That is, it is an object of the present invention to provide a sanitary facility room for a clean room in which a splashing of sewage or adhesion of filth during use of the sanitary facility is prevented and the occurrence of dust can be prevented.

It is another object of the present invention to provide a sanitary facility room for a clean room in which user can utilize the sanitary facility without touching it with his hands at all.

It is still a further object of the present invention to provide a sanitary facility room for a clean room in which a user can completely utilize the sanitary facility without using any toilet paper or towel even after utilization of the facility.

It is still a yet further object of the present invention to provide a sanitary facility room for a clean room in which odor in the toilet bowl or dust in the hand washing bowl can be discharged.

It is still further object of the present invention to provide a sanitary facility room for a clean room in which the sanitary facility equipment can easily be installed on site.

The above-mentioned first object can be accomplished by a method wherein a water feeding part is operated during use of the sanitary facility, washing water is fed to the sanitary facility, and a water film is formed at the inner surface of sanitary facility.

The above-mentioned second object can be attained by a method wherein the water feeding part is operated in response to a human sensing operation at a sensing part.

The above-mentioned third object can be accomplished by a method wherein the toilet bowl is provided with a local washing and drying device for cleaning and drying a local part of a human body and further a hand washing bowl is provided with a hot air supplying device for use in drying the hands.

The above-mentioned fourth object can be attained by a method wherein the toilet bowl and the hand washing bowl are provided with an air bleeding device for discharging interior air, respectively.

The above-mentioned fifth object can be accomplished by a method wherein a functioning part and a control part for the water feeding part are fixed and arranged in the fixing frames which are integrally assembled at the rear part of the sanitary instrument, or from its bottom part to its upper part through the rear part, and these functioning and control parts of the water feeding part are covered by cover panels which are fixed between the fixing frames.

BRIEF DESCRIPTION OF THE DRAWINGS

Other objects and features of the present invention will become apparent from the following description taken in conjunction with the attached drawings.

FIG. 20 is a time chart for use in performing an automatic control.

DETAILED DESCRIPTION OF THE PREFERRED EMBODIMENTS

Figure 1:
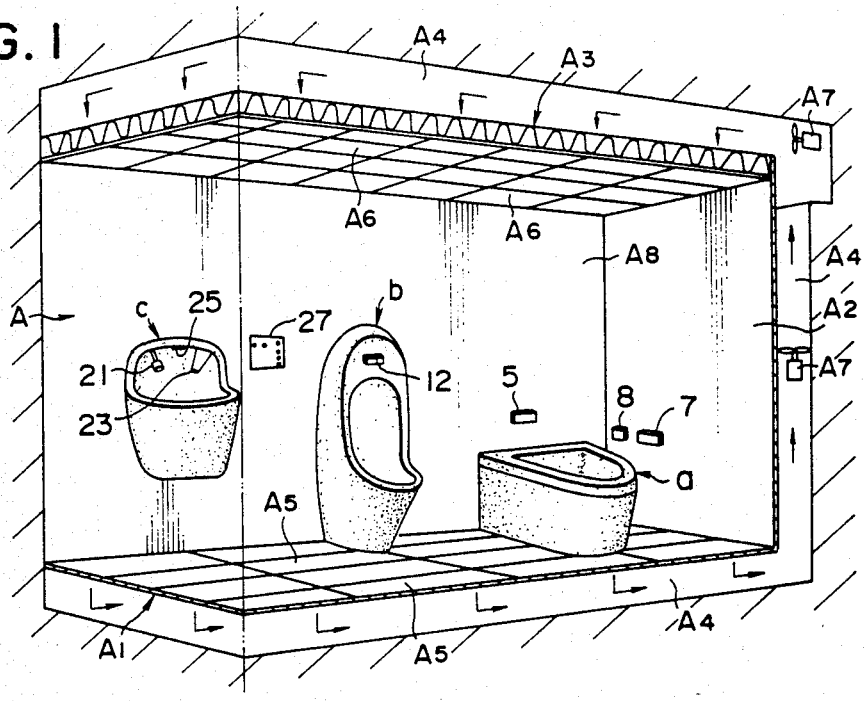
FIG. 1 is a perspective view in section for showing a sanitary facility room for a clean room for illustrating one preferred embodiment of the present invention.

In reference to FIG. 1, one preferred embodiment of the present invention will be described. This figure shows a case in which a toilet bowl (a), a toilet bowl (b) and a hand washing bowl (c) are arranged in a unit room (A).

The unit room (A) is formed with an air passage ($A_4$) communicating with the interior of its floor ($A_1$), interior of a side wall ($A_2$) and interior of a ceiling ($A_3$), and a grating ($A_5$) having several vent holes therein is arranged over an entire floor surface, and in turn an entire ceiling wall is provided with air filters ($A_6$). Interior air is forcedly circulated by a circulation blower ($A_7$) arranged midway in the air passage ($A_4$), thereby clean and fresh air is always supplied through air filters ($A_6$) and the atmosphere in the room is kept clean. Each of the air filters ($A_6$) is a high grade filter which can collect dusts from ultra fine particles, and its efficiency of collection is more than 99.7%.

Figure 2:
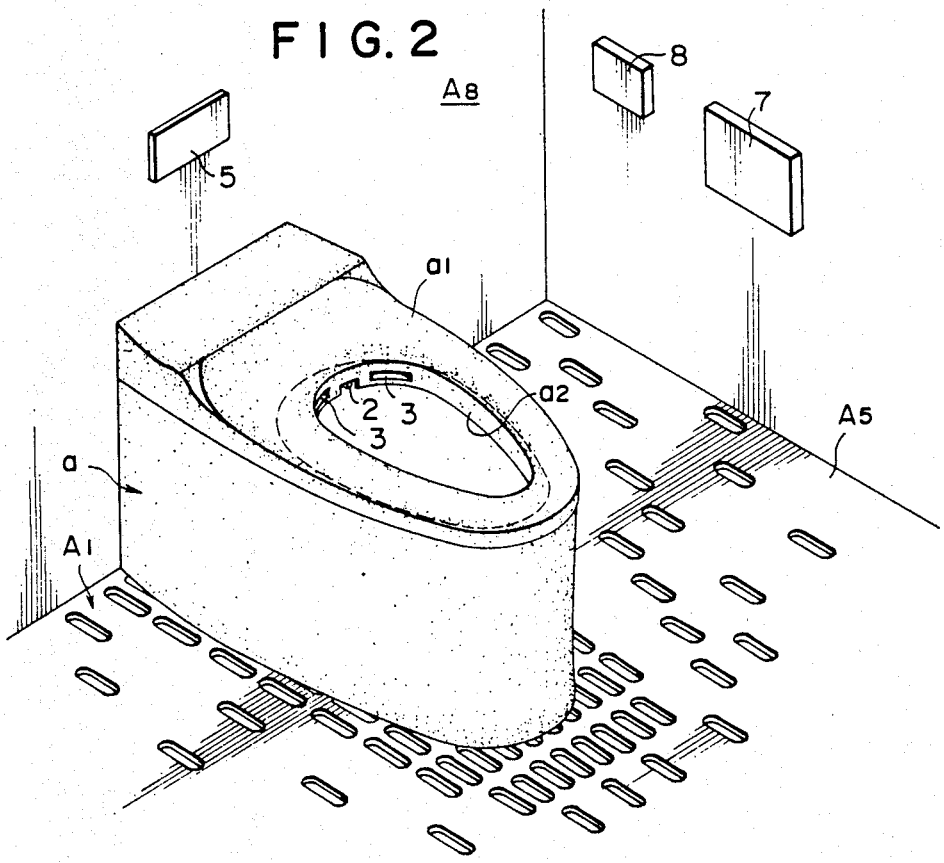
FIG. 2 is a perspective view for showing a toilet bowl.
Figure 3:
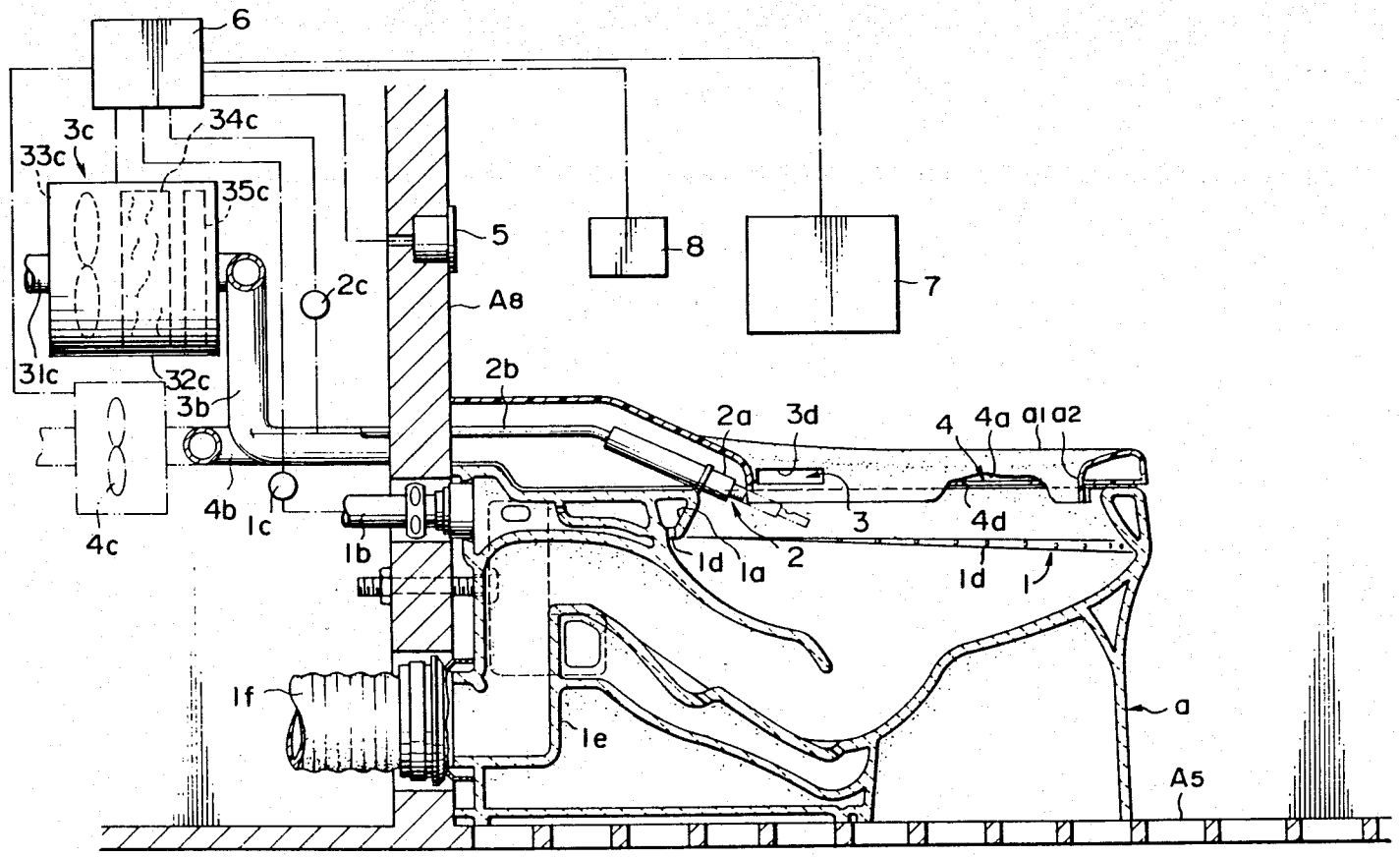
FIG. 3 is a longitudinal side elevation view of FIG. 2.
Figure 4:
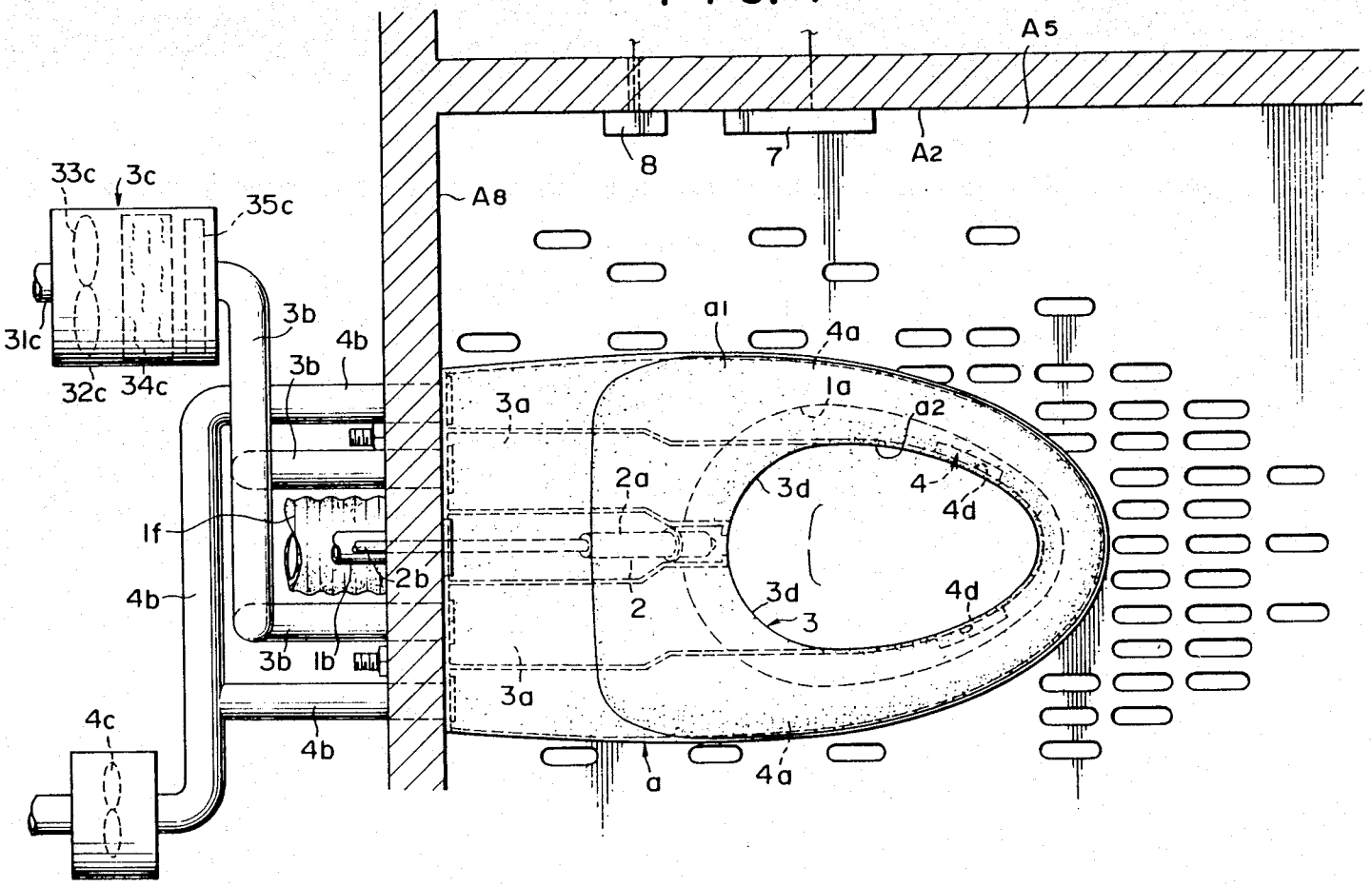
FIG. 4 is a cross sectional top plan view of FIG. 2.

The toilet bowl (a) is provided with a water supplying part (1) for cleaning the interior of the toilet bowl (a) as shown in FIGS. 2 to 4 and, a local cleaning device (2) and local drying devices (3) constituting a local cleaning and drying device for use in cleaning a local part of a user and thereafter drying the local part, an air bleeding device (4) for discharging odor in the toilet bowl (a), and a control part (6) for receiving a sensing signal from a sensing part (5) for sensing a human body and a signal from a operating part (7) for controlling each of the operations of the devices.

The water supplying part (1) is made such that a water passage (1*a*) communicating with a source of water is formed at an outer circumference of the toilet bowl (a), a water supplying pipe (1*b*) is connected to the water passage (1*a*), a solenoid valve (1*c*) is arranged midway in of the water supplying pipe (1*b*), the solenoid valve (1*c*) is electrically connected to the control part (6), the solenoid valve (1*c*) is opened for a predetermined perod of time under an instruction from the control part (6), cleaning water is supplied to the water passage (1*a*) from the water supplying pipe (1*b*), and cleaning water flows along the inner wall of the toilet bowl (a) from several water flowing ports (1*d*) open at the bottom wall of the water passage (1*a*) so as to clean the toilet bowl (a). The water supplying pipe (1*b*) and the solenoid valve (1*c*) are placed out of the unit room (A), so as not to hinder the flow of the clean air in the unit room (A) and then they are connected to the source of water.

Cleaning water from the water supplying part (1) and sewage in the toilet bowl (a) are discharged out of the unit room (A) through a drain trap (1*e*) and a drain pipe (1*f*) connected to the drain trap.

The local cleaning device (2) is made such that a cleaning water injection nozzle (2*a*) is arranged at the lower surface of seat (A1), the nozzle (2*a*) is connected to the source of hot cleaning water through the water supplying pipe (2*b*) and the solenoid valve (2*c*), solenoid valve (2*c*) is electrically connected to the control part (6), solenoid valve (2*c*) is opened under an instruction from the control part (6), cleaning water of desired temperature is supplied to the cleaning water injection nozzle (2*a*) through the water supplying pipe (2*b*), and the nozzle (2*a*) injects cleaning water toward the local part of the user so as to clean the local part. The cleaning water injection nozzle (2*a*) can be extended out or retracted from an opening (a2) of seat (a1), and it is set such that it projects with respect to the opening (a2) an amount which is different during each anus cleaning and bidet-type cleaning, respectively. The water supplying pipe (2*a*) and the solenoid valve (2*c*) are out of the unit room (A) due to reasons similar to those in the case of the toilet bowl cleaning device.

Local drying devices (3) are made such that hot air passages (3*a*) are defined within seat (a1), in which the passages (3*a*) are connected to a hot air generating machine (3*c*) through air feeding pipes (3*b*) for guiding passages out of the unit room (A), and the hot air generating machine (3*c*) is electrically connected to control part (6). The hot air generating machine (3*c*) is operated under instructions from the control part (6) to feed hot air to the hot air passages (3*a*), and hot air is injected toward the local part of the user from injection ports (3*d*) opened at the front end walls of the passages (3*a*) so as to dry the local part of the user. The hot air generating machine (3*c*) is placed out of the unit room (A), and within the casing (32*c*) to which the suction pipe (31*c*) is connected are sequentially arranged a blower fan (33*c*), an air filter (34*c*) having a high efficiency of collection, and a ceramic heater (35*c*) generating no oxides; and further the hot air generating machine has a lower thermal loss and can supply clean hot air in such a way so that the air does not pollute the interior of the unit room (A).

An air bleeding device (4) is made such that an air bleeding passage (4*a*) is defined at an outer circumference of the seat (a1), bleeding passage (4*a*) is communicated with the forced discharging fan (4*c*) through discharging pipes (4*b*) for guiding passages out of the unit room (A), the bleeding fan (4*c*) is electrically connected to the control part (6), the forced discharging fan (4*c*) is operated under instructions from the control part (6), odor in the toilet bowl (a) is suctioned from the suction port (4*d*) opening to the bottom wall of the discharging passage (4*a*) and is then discharged out of the unit room (A).

Figure 5:
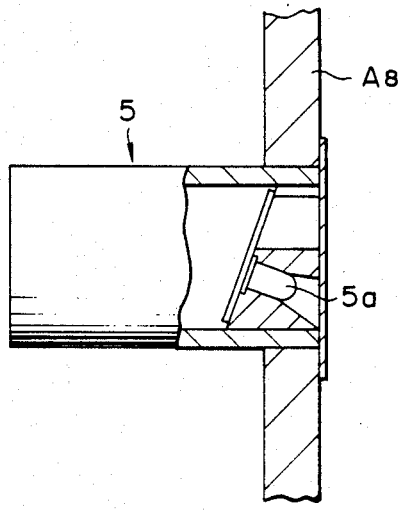
FIG. 5 is a side elevation view partly broken away for showing an enlarged sensing part.

A sensing part (5) comprises a photoelectric sensor which is fixed at the rear upper position of the toilet bowl (a) at the rear wall ($A_8$) of the unit room (A), and which is electrically connected to the control part (6). The sensor detects a human body during use of the toilet bowl, sends a sensed signal to the control part (6)

and verifies to the control part (6) that beginning of the use of the toilet bowl has occurred. The sensing part (5) is made such that as shown in FIG. 5 a light emitting and receiving element (5*a*) is inclined forwardly and downwardly, a sensing area is restricted near the toilet bowl (a), and an erroneous operation is prevented in such a case as, for example, other than the use of toilet bowl, i.e., when a man merely passes by in front of the toilet bowl (a), it may not detect the human body.

Figure 6:
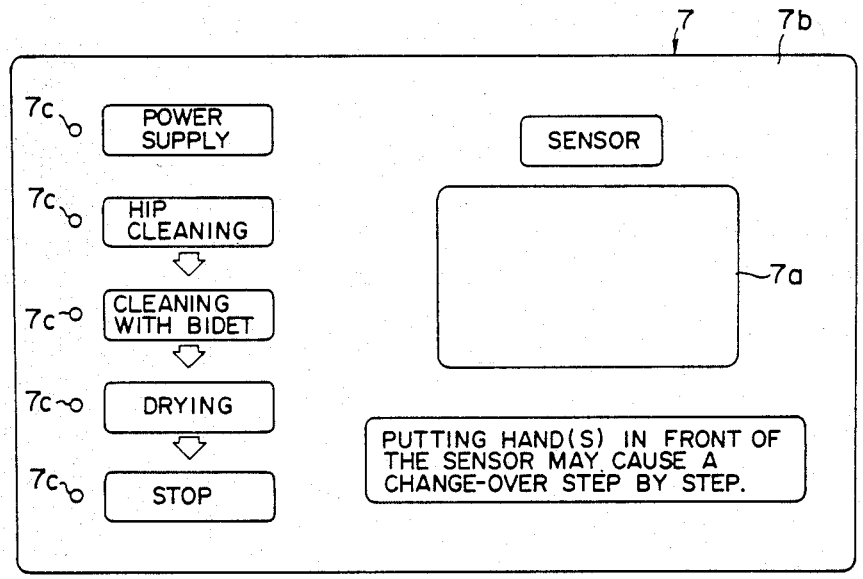
FIG. 6 is an enlarged front elevation view for showing an operating part.

The operating part (7) is used for making a manual changeover operation between the local cleaning device (2) and the local drying devices (3), wherein as shown in FIG. 6, a photoelectric sensor (7*a*) is assembled in the operating panel (7*b*) and arranged at the upper side position of the toilet bowl (a) at the side wall ($A_2$) of the unit room (A). The operating part is electrically connected to the control part (6) and the photoelectrical sensor (7*a*) detects the hands of the user during a change-over operation and sends the sensed signal to the control part (6). That is, every time the user places his hands in front of the photoelectrical sensor (7*a*), operations of the local cleaning device (2) and the local drying devices (3) change over among a local cleaning, cleaning with bidet, drying, and stop. Operation of the operating part (7) is allowed only when the sensing part (5) is operated, operation other than use of toilet bowl sensed by the sensing part (5) is prohibited, and cleaning water is prevented from accidentally being injected at the cleaning water injection nozzle (2*a*) in the local cleaning device (2) other than during occasional use of the toilet bowl, water is further prevented from staining unit room (A).

Receipt of a signal sent from the operating part (7) to the control part (6) is cancelled when a signal output time is within a desired period of time, e.g., less than 0.5 seconds; subsequent signals are also cancelled when the output interval of signals is less than a desired period of time, e.g. less than 1 second, and operations of the local cleaning device (2) and the local drying device (3) are not unnecessarily changed over.

The operating panel (7*b*) is provided with a display for indicating operating conditions of the presence or the absence of the power supply input ranging from the cleaning to stop, and is provided with light emitting diodes (7*c*) near the display for indicating the operations. At a position near the operating panel (7*b*) a water force adjusting operating panel (8) is arranged for use in adjusting the water force from the cleaning water injection nozzle (2*a*) in the local cleaning device (2).

Figure 7:
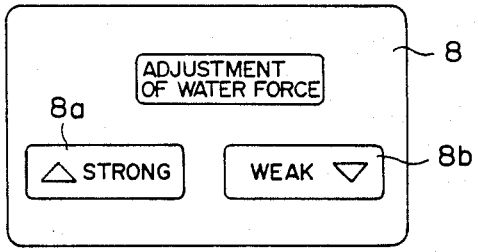
FIG. 7 is an enlarged front elevation view for showing a water force adjusting control panel.

The operating panel (8) is provided with water force adjusting switches (8*a*) and (8*b*) as shown in FIG. 7. The switches (8*a*) and (8*b*) are so-called manual touch switches. These switches are relatively less frequently used and only a part of the finger tip is contacted with the switches, so the slight adhesion of hand stains may not generate any troubles at all.

Figure 8:
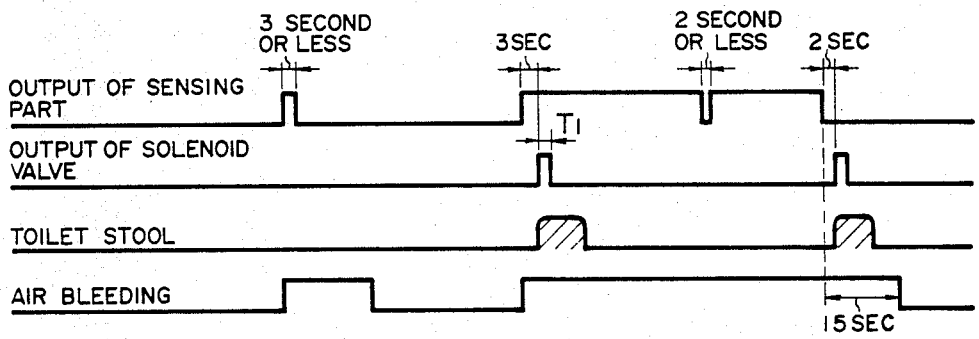
FIG. 8 is a time chart for use in performing a cleaning of a toilet bowl.
Figure 9:
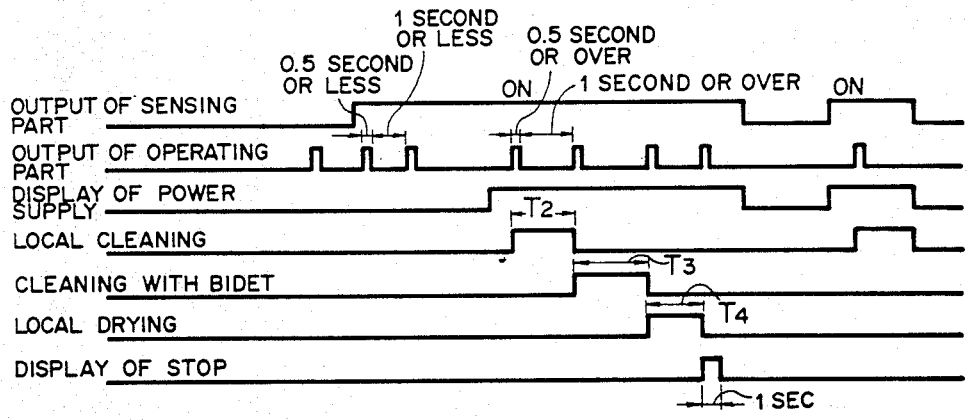
FIG. 9 is a time chart for use in performing a local cleaning and drying operation.
Figure 10:
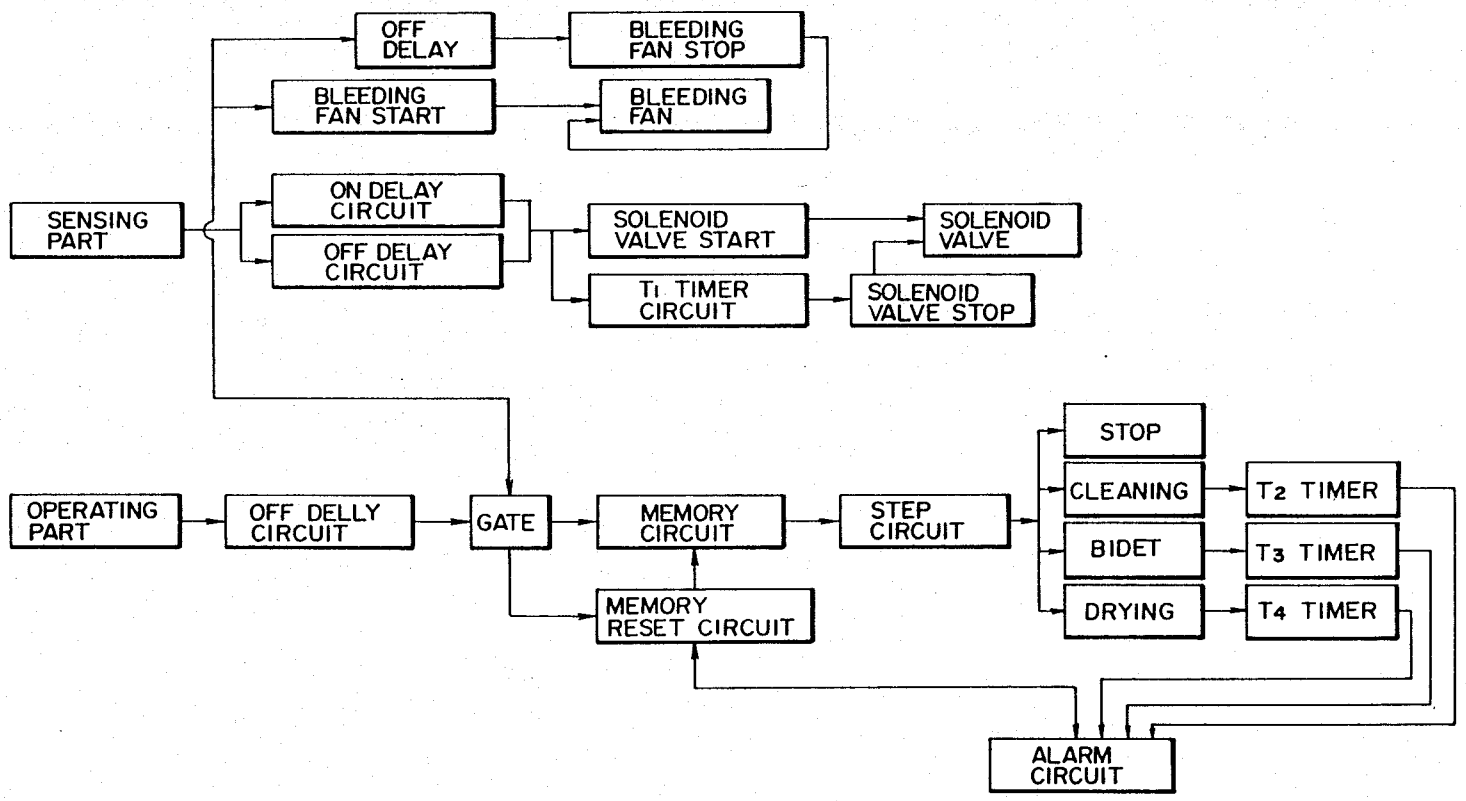
FIG. 10 is a flow chart for use in performing a cleaning of toilet bowl, a local cleaning and a drying operation.

Operations of the toilet bowl (a) during its use described above are performed in reference to the time chart and the flow chart as shown in FIGS. 8 and 10.

That is, the user sits on the seat (a1), the sensing part (5) detects the human body and the sensed signal is sent to the control part (6). This sensed signal is cancelled, within a desired time, e.g. within tree seconds, and useless operation of the water supplying part (1), local cleaning device (2) and the local drying devices (3) are prevented.

When the sensed signal is fed to the control part (6) for more than three seconds, the solenoid valve (1*c*) of the water supplying part (1) is opened and a preparatory cleaning of the toilet bowl (a) is carried out; and, at the same time, the power supply for the operating part (7) is turned on. Further, when the sensing part (5) detects the human body, at the same time the forced discharging fan (4*c*) for the air bleeding device (4) is operated, and the discharging or bleeding of odor is started under suction at the suction port (4*d*).

The reason why the preparatory cleaning is performed consists in the fact that water film is formed at the inner wall surface of the toilet bowl (a) in advance, and so that stains after use of the toilet bowl may easily be removed.

And the bleeding operation is continued during the use of the toilet bowl in such a way that odors can be discharged without leaving them as well as for a desired period of time, for example, 15 seconds after the user has moved away from the toilet bowl, upon completion of the use of the toilet bowl, cleaning of the local part; and drying of the local part and even after the output of the sensed signal of the sensing part (5) is stopped and after output of the sensed signal is stopped.

Upon completion of use of the toilet bowl, the user sets his hands in front of the photoelectric sensor (7*a*) at the operating part (7) to cause the sensor (7*a*) to detect the hands; thereby, the local cleaning device (2) starts to operate with the output of the first sensed signal and the cleaning of the local part is carried out with the cleaning water injected from the cleaning water injection nozzle (2*a*).

After completion of the local cleaning operation, a second sensing signal is outputted at the photoelectric sensor (7*a*) at the operating part (7) again during a manual operation and cleaning with a bidet can be carried out.

After washing with a bidet, or in cases where cleaning with bidet is not required, a third sensing signal is subsequently outputted at the photoelectrical sensor (7*a*) of the operating part (7); thereby, the local drying devices (3) start to operate, hot air is blown from the blowing ports (3*d*), and then the local part is dried. A ceramic heater (35*c*) in the local drying devices (3) begin to heat when the sensing signal of the sensing part (5*a*) is outputted, and hot air is fed instantly by a blower fan (33*c*) when the drying operation is started.

A fourth sensing signal is outputted at the photoelectric sensor (7*a*) of the operating part (7); thereby, operation of the local drying devices (3) is stopped and a light emitting diode (7*c*) for displaying a stopped condition in the operating panel (7*b*) is illuminated for about one second.

Further, upon completion of cleaning after use of the toilet bowl and drying of it in such a manner as described above, when the user moves away from the toilet bowl (a), input from sensing part (5) to control part (6) is stopped, and the power supply for the operating part (7) is turned off and, at the same time the solenoid valve (1*c*) of the water supplying part (1) is opened again for a desired period of time under instructions from the control part (6) after a desired interval, for example, 2 seconds after the input of the signal is stopped. Thus, a major cleaning of the toilet bowl is carried out and sewage is discharged out of the toilet bowl (a). After the input of the sensed signal from the sensing part (5) is stopped and after a desired period of time, for example, 15 seconds, has elapsed, operation of the bleeding device is stopped and all of the operations are also stopped.

In this way, under conditions in which all of the operations are stopped, that is, at a time other than during use of the toilet bowl, the power supply for the operating part (7) is kept turned off, so that the operating part (7) does not detect the human body so long as the sensing part (5) does not output any sensing signals; and it does not produce any outputs and thus, it is possible to prevent erroneous, i.e., unintended, operation of the local cleaning device (2) and the local drying devices (3).

The local cleaning device (2) and the local drying devices (3) continue their operations within a desired period of time set by the control part (6) until the operating part (7) produces a new sensed signal, and stop automatically after the desired period of time is elapsed. The set time is set to, for example, 5 minutes in case of performing local cleaning and cleaning with bidet, and it is set at 10 minutes for example when performing a local drying operation.

After the set time is elapsed, an alarm device will be operated after the local cleaning device (2) and the local drying devices (3) are stopped, and this alarm device will generate an alarm.

Figure 11:
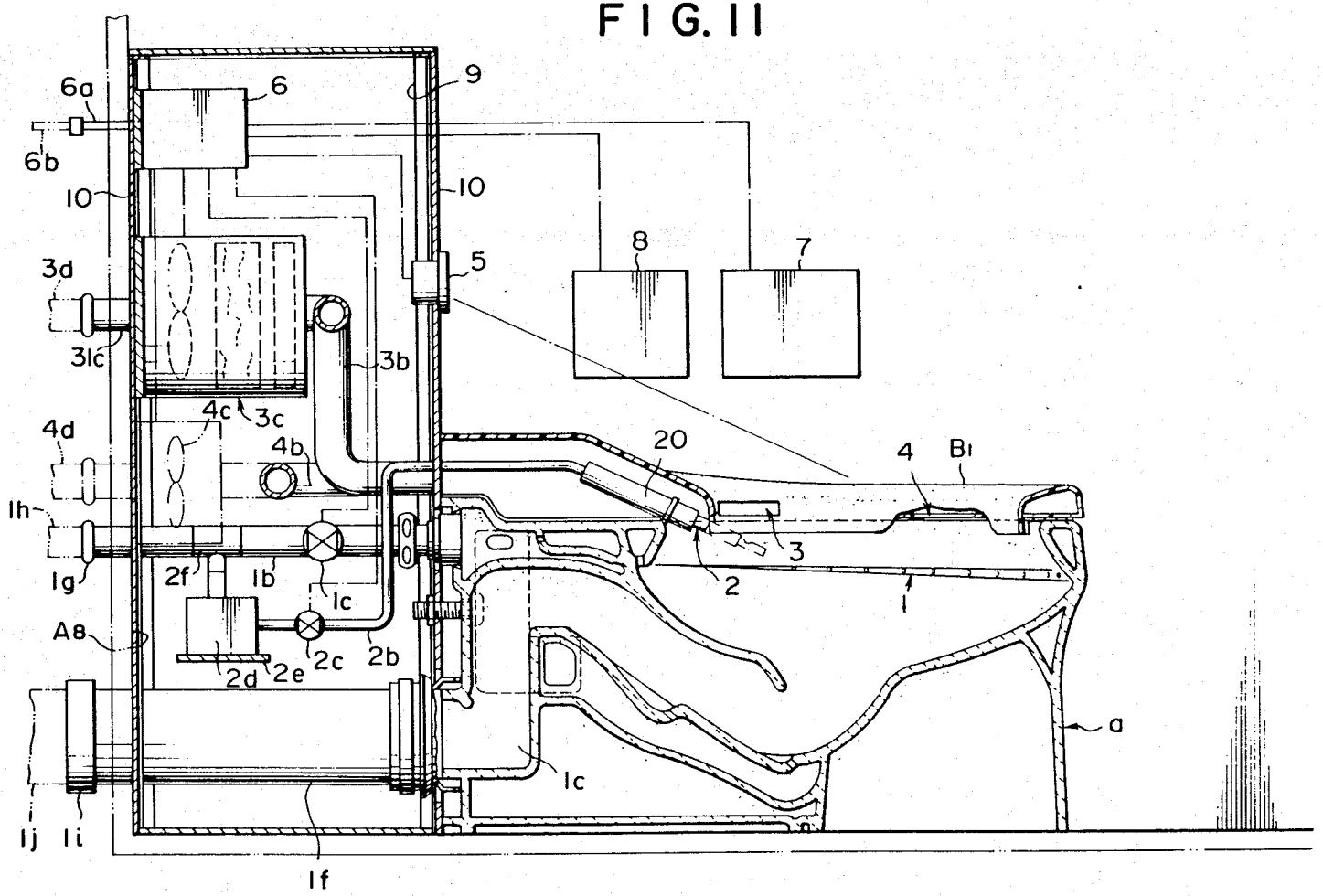
FIG. 11 is a longitudinal side elevation view for showing another preferred embodiment of a toilet bowl.
Figure 12:
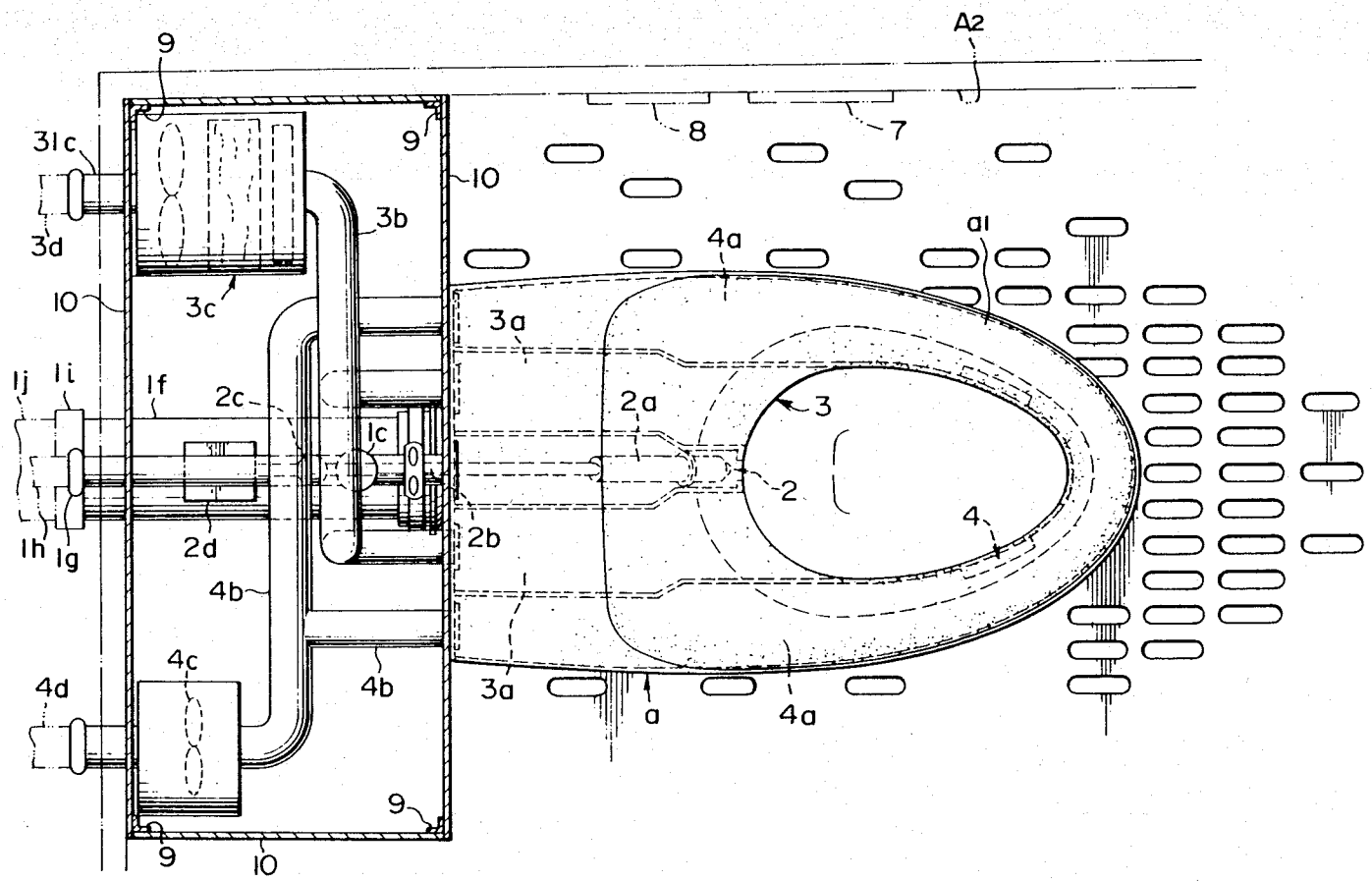
FIG. 12 is a cross sectional view in top plan of FIG. 11.

FIGS. 11 and 12 illustrate another preferred embodiment of a toilet bowl (a), wherein fixing frames (9) are integrally assembled and formed at the rear part of the toilet bowl (a). Within the fixing frames (9) are fixed and arranged the water supplying part (1), local cleaning device (2), local drying devices (3), the functioning part of the discharging device (4), and the control part (6). Cover panels (10) are fixed between the fixing frames (9), thereby covering the functioning part of each of the devices and the control part (6) so as to make a unified assembly.

The fixing frames (9) are assembled in a box-like form higher than the toilet bowl (a) and the seat (a1), a sensing part (5) is fixed to the cover panel (10) covering the front surface, and at the same time a code (6*a*) pulled out of the control part (6) can be connected to a power supply code (6*b*) arranged out of the cover panel (10).

The functioning part of the water supplying part (1) corresponds to the water supplying pipe (1*b*) and the solenoid valve (1*c*), the base end of the water supplying part (1*b*) is passed through the cover panel (10) and projected outwardly and can be further connected to a main water supplying pipe (1*h*) through a connector (1*g*).

The base end of drain pipe (1*f*) connected to the toilet bowl (a) is similarly passed through the cover panel (10), projected outwardly, and can be connected to the main drain pipe (1*j*) through a connector (1*i*).

The functioning part of the local cleaning device (2) comprises the water supplying pipe (2*b*) and the solenoid valve (2*c*), except that a cleaning injection nozzle (2*a*) and a hot water heater (2*d*) is connected to the end of the water supplying pipe (2*b*) as shown in the drawings, and the hot water heater (2*d*) is mounted on and fixed to a mounting plate (2*e*) arranged within the fixing frames (9) and at the same time, the heater is connected to the midway part of the water supplying pipe (1*b*) of the water supplying part (1) through a branch pipe (2*f*).

The functioning part of the local drying devices (3) comprises to the air blowing pipe (3*b*) and the hot air generating machine (3*c*), and the base end of the suction pipe (31*c*) of the hot air generating machine (3*c*) is passed through the cover panel (10), projected outwardly, and can be connected to the main suction pipe (3*d*).

The functioning part of the bleeding device (4) comprises a bleeding pipe (4*b*) and a forced bleeding fan (4*c*), the base end of the bleeding pipe (4*b*) is passed through the cover panel (10) and projected outwardly and can be connected to the main bleeding pipe (4*d*).

Therefore, the system shown in FIGS. 11 and 12 can be completed on site only by connecting a power supply code (6*b*), main water supplying pipe (1*h*), main drain pipe (1*j*), suction main pipe (3*d*) and bleeding main pipe (4*d*). Since this system has no troublesome operation, as found in FIGS. 3 and 4, in which the functioning part of each of the devices and the control part (6) are separately arranged and they must thereafter be connected to each other, the result is that their mounting work is quite simple and convenient.

Now, a toilet bowl (b) will be described as follows.

Figure 13:
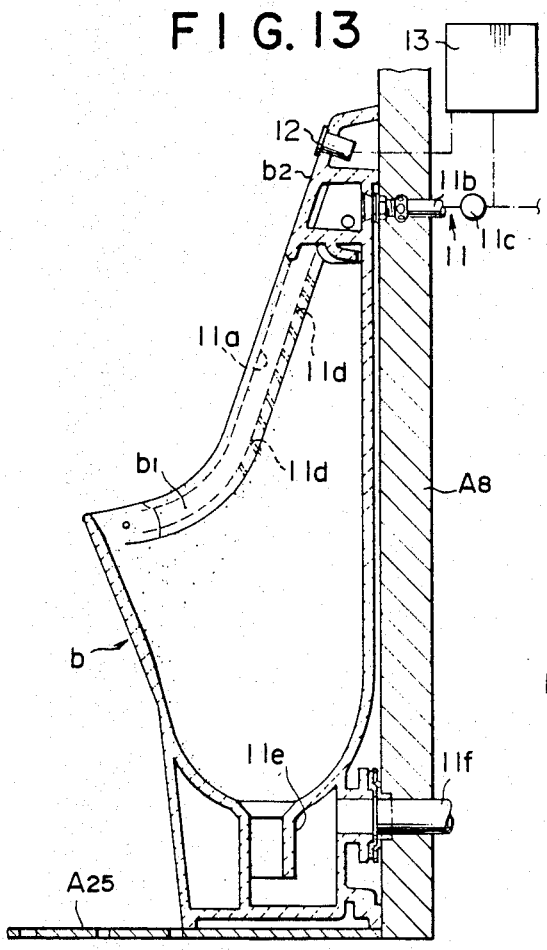
FIG. 13 is a longitudinal side elevation view for showing a toilet bowl.
Figure 14:
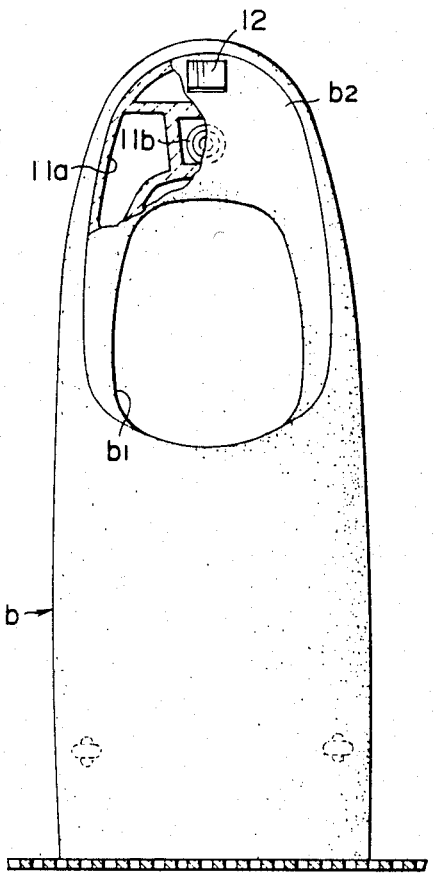
FIG. 14 is a front elevation view partly broken away.
Figure 15:
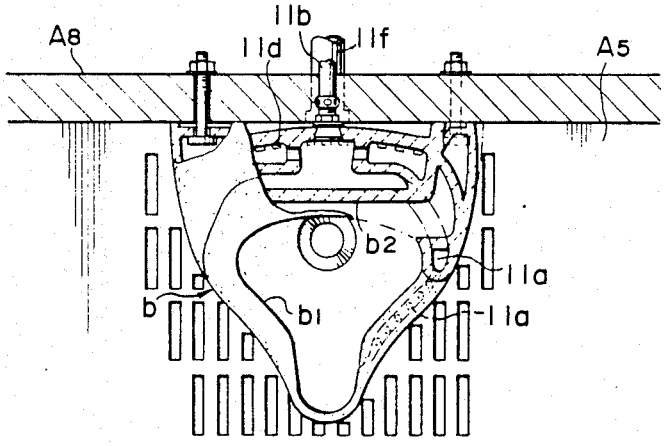
FIG. 15 is a top plan view partly broken away.

As shown in FIGS. 13 to 15, the toilet bowl (b) is provided with a water supplying part (11) for cleaning the interior of the toilet bowl (b) and a control part (13) for receiving a sensed signal from a sensing part (12) sensing the human body and for controlling the operation of the water supplying part (11).

the water supplying part (11) has a water passage (11*a*) along an entire circumference of the opening (b1), the water passage (11*a*) is connected to a water supplying source through the water supplying pipe (11*b*) extending out of the unit room (A), a solenoid valve (11*c*) is arranged in the water supplying pipe (11*b*), the solenoid valve (11*c*) is electrically connected to the control part (13), and solenoid valve (11*c*) is opened under instructions from the control part (13), the cleaning water is supplied from the water supplying pipe (11*b*) to the water passage (11*a*). The cleaning water flows from several water flowing holes (11*d*) opening at the bottom wall of the water passage (11*a*) along the inner wall of the toilet bowl (b), so as to clean the interior of the toilet bowl (b). The cleaning water and sewage from the water supplying part (11) are discharged outwardly of the unit room (A) from the toilet bowl (b) through a drain trap (11*e*) and a drain pipe (11*f*).

Figure 16:
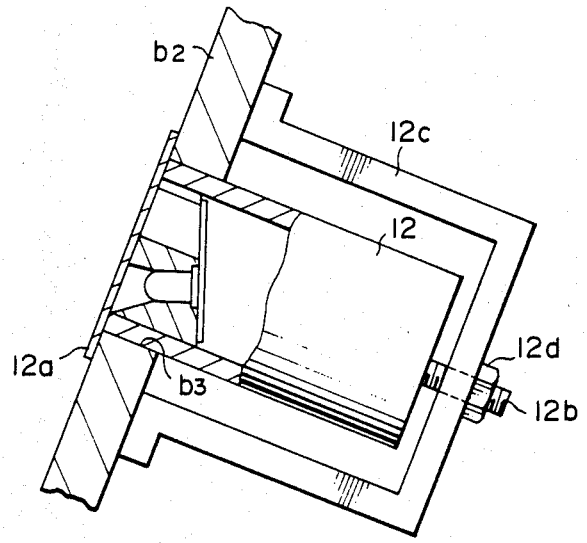
FIG. 16 is a side elevation view partly broken away for showing an enlarged fixing structure for a sensing part.

The sensing part (12) is comprised of a photoelectric sensor, detects a human body standing in front of the toilet bowl (b) when the toilet bowl is being used, sends the sensed signal to the control part (13), causes the control part (13) to acknowledge the starting of use of the toilet bowl, and the sensing part is fixed in a flush fashion, to the upper front wall (b2) of the toilet bowl (b) in such a way so that it will not hinder the flow of clean air within the unit room (A). A fixing structure for the sensing part (12) is constructed as shown in FIG. 16, wherein the sensing part (12) is inserted and fixed to a front wall (b2) of the toilet bowl (b) through a fixing hole (b3), a front end flange (12*a*) of the sensing part (12) is abutted against an outer surface of the front wall (b2) and, in turn a fixing threaded shaft (12*b*) at the rear end is fixed to the inner surface of the front wall (b2) through bracket (12*c*) and nut (12*d*).

Figure 17:
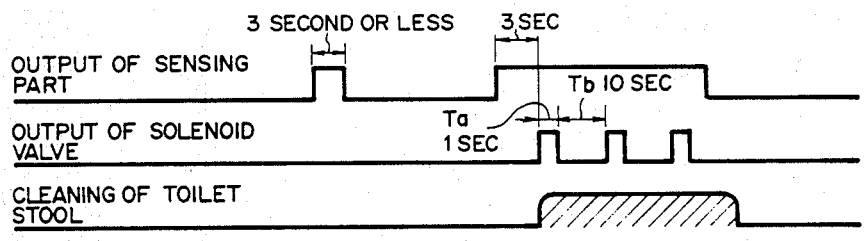
FIG. 17 is a time chart for use in performing a cleaning of a toilet bowl.
Figure 18:
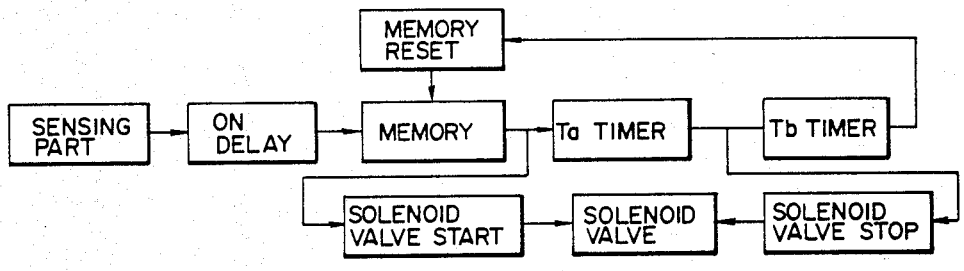
FIG. 18 is a flow chart of for performing a cleaning operation.

Operation of the toilet bowl (b) during use of the toilet bowl (b) as described above is performed with reference to the time chart and the flow chart shown in FIGS. 17 and 18.

That is, when the user stands in front of the toilet bowl (b), the sensing part (12) detects the human body and sends the sensed signal to the control part (13). This sensed signal will be cancelled when the output has a desired period of time, for example, within three seconds, and useless operation of the water supplying part (11) will be prevented.

When the sensed signal is inputted to the control part (13) for more than three seconds, the solenoid valve (11*c*) of the water supplying part (11) will be opened under instructions from the control part (13), and then cleaning of the toilet bowl (b) will be started before use the toilet bowl. The duration of the solenoid valve (11*c*) is one second, the solenoid valve (11*c*) is closed after the time of opening of the valve is elapsed, the valve will be opened again after six seconds, and periodic opening and closing operation of the solenoid valve (11*c*) is repeated several times within the period of use of the toilet bowl.

The valve opening time or valve closing time of the solenoid valve (11*c*) is counted by a timer at the control part (13), and the solenoid valve (11*c*) is opened or closed with within the period of setting time at the control part.

Thus, a proper amount of cleaning water is supplied into the toilet bowl (b) continously from a time before starting use of the toilet bowl until the time after completion of use of the toilet bowl under a periodic opening and closing operation of the solenoid valve (11*c*); a water film is always formed at the inner wall of the toilet bowl (b), the bowl is cleaned without any remaining urine component and no odor will be produced. That is, even if the user moves away from a front part of the toilet bowl (b) upon completion of use of the bowl and input of the sensing signal from the sensing part (12) to the control part (13) is stopped, the cleaning water supplied under the opening of the solenoid valve (11*c*) before its stoppage cleans the interior of the toilet bowl (b).

Figure 20:
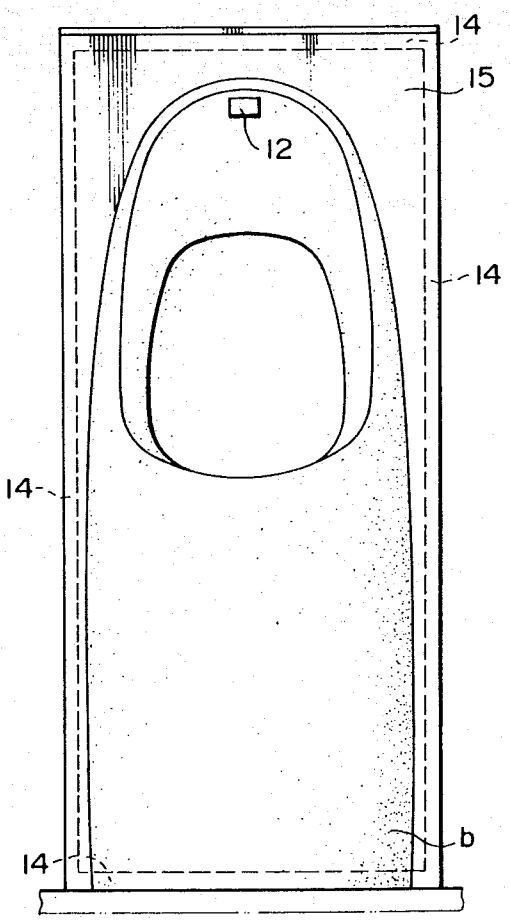
FIG. 20 is a front elevational view of FIG. 19.
Figure 19:
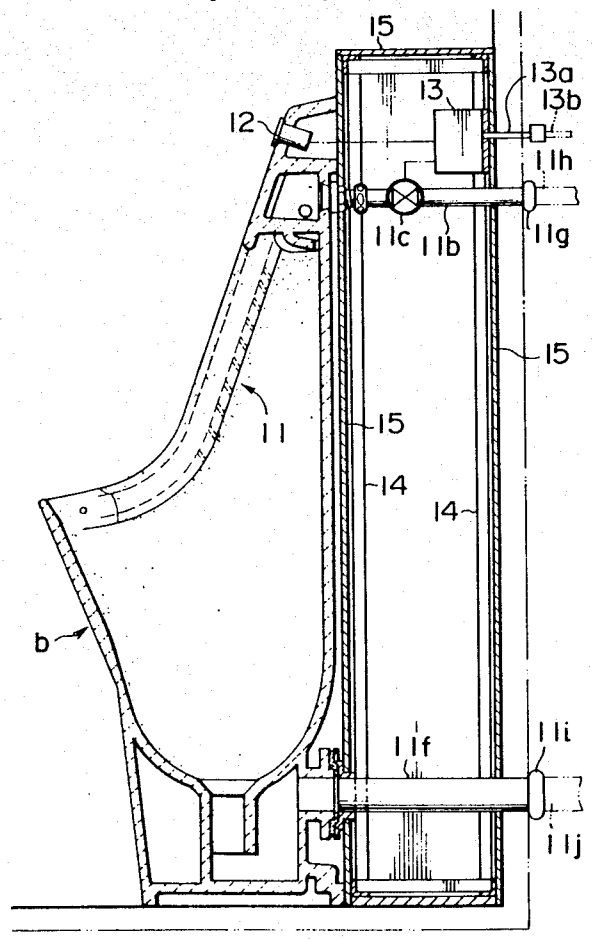
FIG. 19 is a longitudinal side elevation in section for showing another preferred embodiment of a toilet bowl.

FIGS. 19 and 20 illustrate another preferred embodiment of the toilet bowl (b), wherein the fixing frames (14) are integrally assembled and formed at the rear part of the toilet bowl (b), the functioning part of the water supplying part (11) and the control part (13) are fixed and arranged in fixing frames (14), and cover panels (15) are fixed between the fixing frames (14) so as to cover the functioning part of the water supplying part (11) and the control part (13) to make a unified assembly.

The fixing frames (14) are assembled to form a box-like shape slightly higher than the height of the toilet bowl (b) and a code (13*a*) pulled out of the control part (13) can be connected to a power supply code (13*b*) arranged outside of the cover panel (15).

The functioning part of the water supplying part (11) corresponds to a water supplying part (11*b*) and a solenoid valve (11*c*), a base end of the water supplying pipe (11*b*) is passed through the cover panel (15) projected outwardly, and can be connected to a main water supplying pipe (11*h*) through a connector (11*g*).

The base end of the drain pipe (11*f*) connected to the toilet bowl (b) is passed through the cover panel (15) in the same manner as that of the water supplying pipe (11*b*), projects outwardly, and can be connected through a main drain pipe (11*j*).

Therefore, the system shown in FIGS. 19 and 20 is completed in its work on site merely by connecting the power supply code (13*a*), main water supplying pipe (11*h*) and the main drain pipe (11*j*), and this system may eliminate troublesome work, such as separate mounting of the functioning part of the water supplying part (11) and the control part (13) and then the necessary connection of these elements, as found in FIGS. 13 to 15, resulting in installation work becoming simple and convenient.

A hand washing bowl will now be described.

The hand washing bowl (c) is supported by a mounting block (c') placed out of the unit room (A), with only its front opening part (c1) and a front wall (c2) around the opening being adjacent to the interior of the unit room (A) from the rear wall ($A_8$). The hand washing bowl (c) is provided with a hand washing water injection device (21) comprising a water supplying part, a bowl cleaning device (22), a hot air heater (23) for drying hands, an air bleeding device (24) in the bowl (c), and a control part (26) for controlling an operation of each of these devices by receiving a sensed signal from a sensing part (25) for sensing presense the hands when the hands are washed. Each of the devices and the control part (26) are arranged within the hand cleaning bowl (c) or out of the unit room (A) so as not to prevent the flow of clain air in the unit room (A).

The hand washing water injection device (21) is arranged such that the water injection nozzle (21*a*) is displaced from an intermediate position by a width direction outwardly on the upper wall surface (c4) of the bowl part (c3) in the hand washing bowl (c), and is fixed to face downward. The nozzle (21*a*) is connected to a water supplying source through the water supplying pipe (21*b*) having a solenoid valve (21*c*) therein, the solenoid valve (21*c*) is electrically connected to the control part (26), the solenoid valve (21*c*) is opened for a specified period of time under instructions from the control part (26) to supply cleaning water to the injection nozzle (21*a*), and the nozzle (21*a*) injects hand washing water into the bowl (c3).

The injection nozzle (21*a*) is inclined at a desired angle toward a vertical line passing through an intermediate position in the width-wise direction of the hand washing bowl (c).

The bowl cleaning device (22) has an annular water passage (22*a*) at the upper circumferential part of and the bowl (c3), the water passage (22*a*) is connected to the water supplying source through a water supplying pipe (22*b*) provided with the solenoid valve (22*c*). The solenoid valve (22*c*) is electrically connected to the control part (26), the solenoid valve (22*c*) is opened under instructions from the control part (26), the cleaning wter is supplied to the water passage (22*a*), and flows from several water flowing holes (22*d*) opening at the bottom wall of the water passage (22*a*) along the inner wall of the bowl (c3) so as to clean the interior of the bowl (c3). The cleaning water from the bowl cleaning device (22) is discharged outwardly of the hand washing bowl (c) and unit room (A) together with cleaning water from the hand washing water injection device through a drain trap (22*e*) and a drain pipe (22*f*).

A hot air heater (23) is provided with a hot air injection nozzle (23*a*) at the upper wall surface (c4) of the bowl part (c3) at a position in its width direction which is symmetrical to the injection nozzle (21*a*). The nozzle (23*a*) is connected to and the hot air generating machine (23*c*) through a flexible pipe (23*b*), the hot air generating machine (23*c*) is electrically connected to the control part (26). The hot air generating machine (23*c*) is operated for a desired period of time under instructions from the control part (26) to send the hot air to the injection nozzle (23*a*) and then the hands are dried by hot air blown from the nozzle (23*a*). The injection nozzle (23*a*) is inclined at the same angle as that of the water injection nozzle (21*a*) towards the vertical line passing through an intermediate position along the width of the hand washing bowl (c). Therefore, putting the hands at the intermediate position along the width of the hand washing bowl (c) causes both cleaning water from the water injection nozzle (21*a*) and hot air from the injection nozzle (23*a*) to be applied to the hands without moving them.

The hot air generating machine (23*c*) is made such that a blower fan (233*c*), air filter (234*c*) and ceramic heater (235*c*) are arranged in sequence from the upstream side within a casing (232*c*) to which a suction pipe (231*c*) is connected. The thermal loss is less, and clean hot air can be fed in such a way that the clean air in the unit room (A) is not polluted.

The air bleeding device (24) in the bowl (c3) is placed adjacent to the rear part of the bowl (c3) to form air bleeding passage (24*a*), the air bleeding passage (24*a*) is connected to a forced air bleeding fan (24*c*) through an air bleeding pipe (24*b*), and at the same time the air bleeding fan (24*c*) is electrically connected to the control part (26), the forced air bleeding fan (24*c*) is operated for a specified period of time under instructions from the control part (26) to suck dust such as effete matter of hands which has dropped into the bowl (c3) under chafing of the hands during drying, from the air bleeding passage (24*a*) together with hot air, and to then discharge them.

Figure 21:
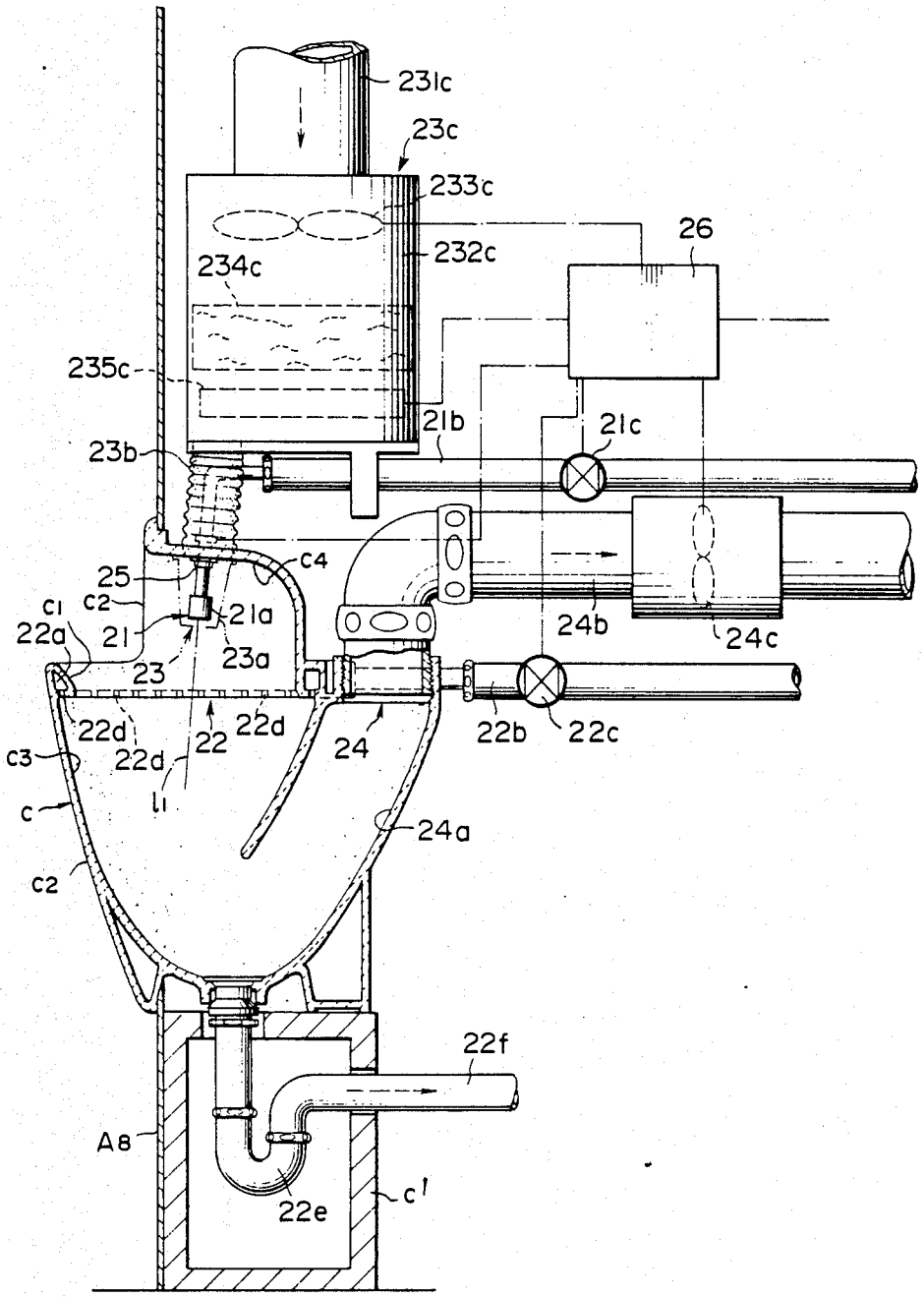
FIG. 21 is a longitudinal side elevational view for showing a hand washing bowl.

The sensing part (23) is comprised of a photoelectric sensor which is arranged at a position in the upper wall surface (c4) of the bowl held between the water injection nozzle (21*a*) and the blowing nozzle (23*a*), that is, an intermediate position in a width direction of the hand cleaning bowl (c), at and as shown in FIG. 21, an optical axis ($l_1$) of the light emitting and light receiving element is inclined downward and forward by a desired angle with respect to a vertical line. The inclination of the optical axis ($l_1$) is made in order to enable the sensing part (25) to be positioned slightly deeper from the opening (c5) of the hand washing bowl (c), in order to prevent any erroneous operation of the sensing part (25) caused by accidental cutting of the light beam emitted from the light emitting element by hands and to enable rapid sensing of hands to be performed when the hands are put into the hand washing bowl (c) through the opening (c5), in case of washing of hands.

Operation of each of the devices in the hand washing bowl (c) is automatically controlled by the control part (26), which received the sensed signal from the sensing part (25). In order to perform both hand washing and drying operations for a desired period of time, it is necessary to have manual control over the operation of each of the devices, and so in the preferred embodiment of the present invention the manual control is performed by a switching operation at the operating panel (27).

Figure 23:
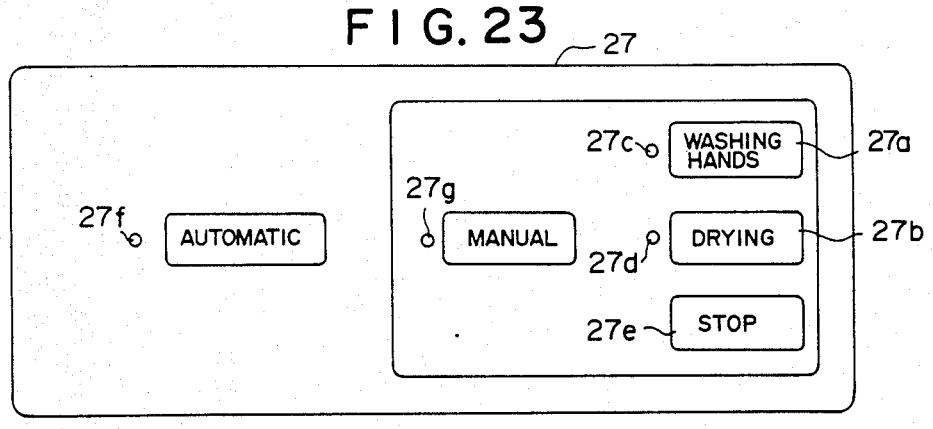
FIG. 23 is an enlarged front elevational view for showing a control panel for use in performing a manual control.
Figure 24:
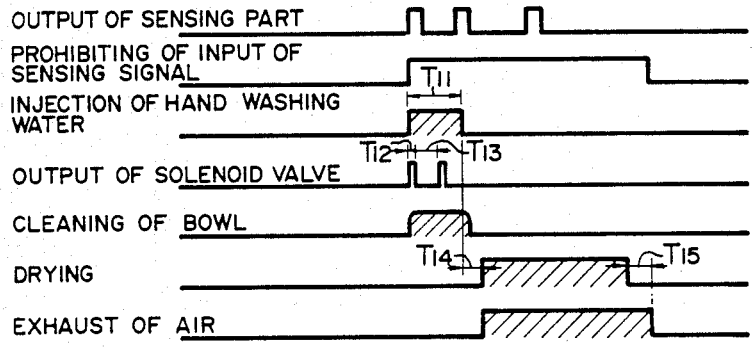
FIG. 24 is a time chart for use in performing manual control.
Figure 26:
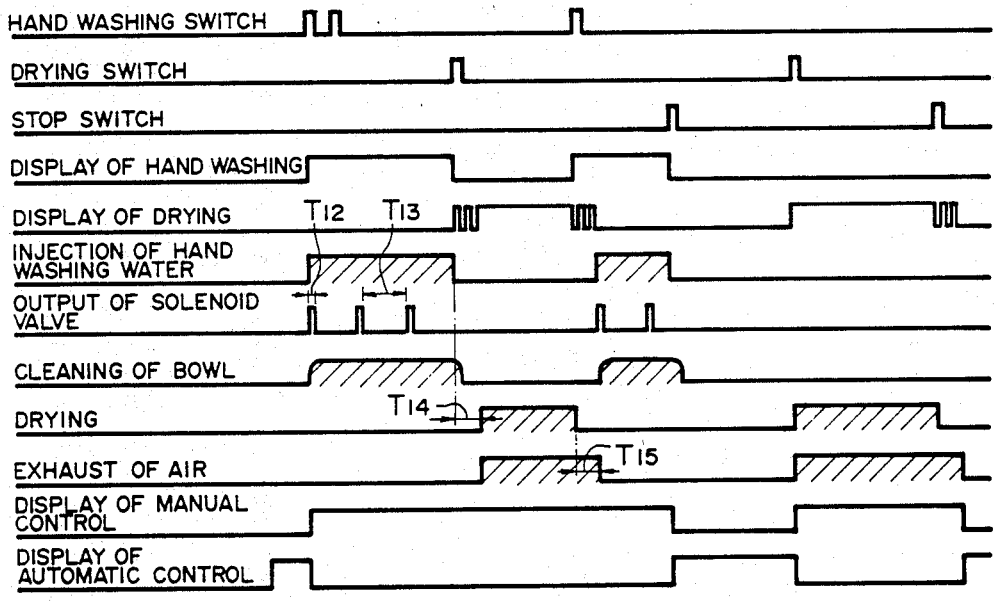
FIG. 26 is a time chart for use in performing manual control.
Figure 25:
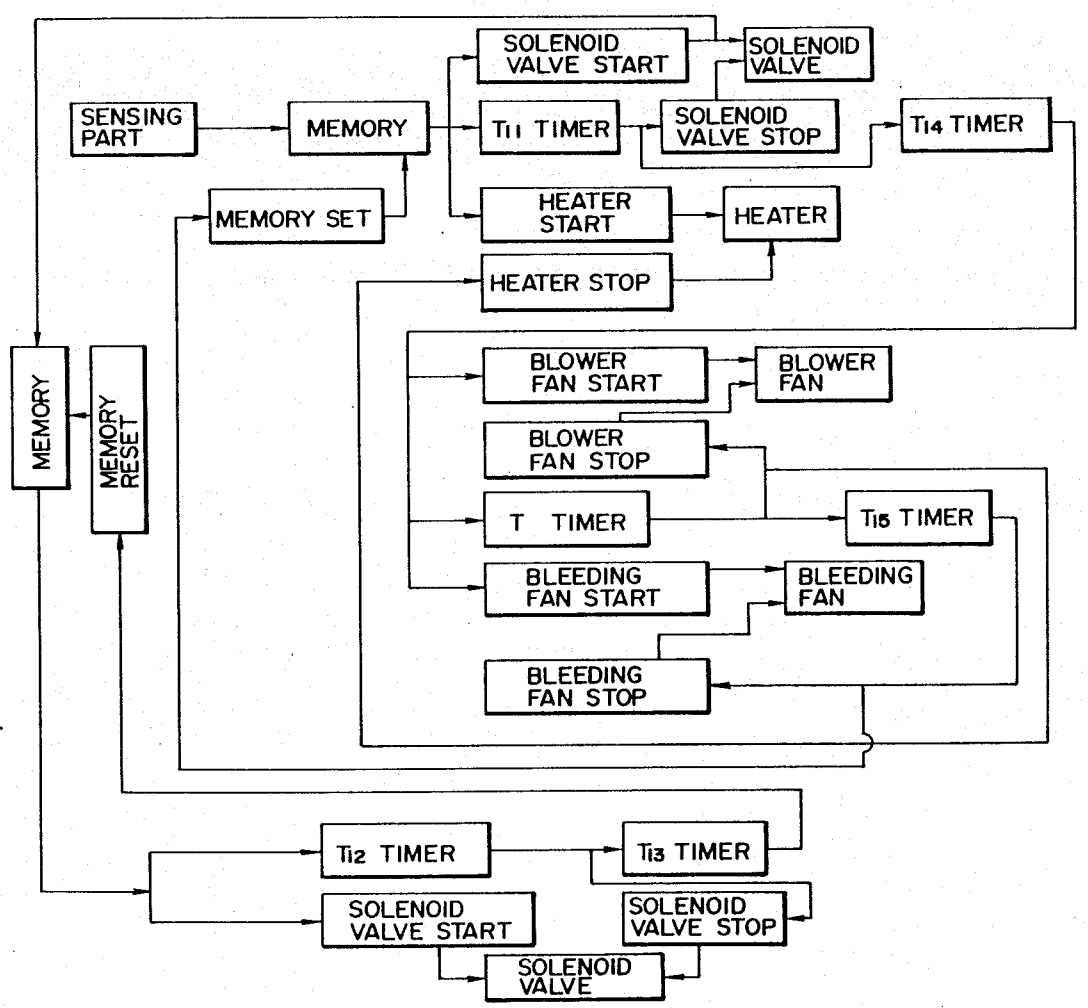
FIG. 25 is a flow chart for use in performing manual control.
Figure 27:
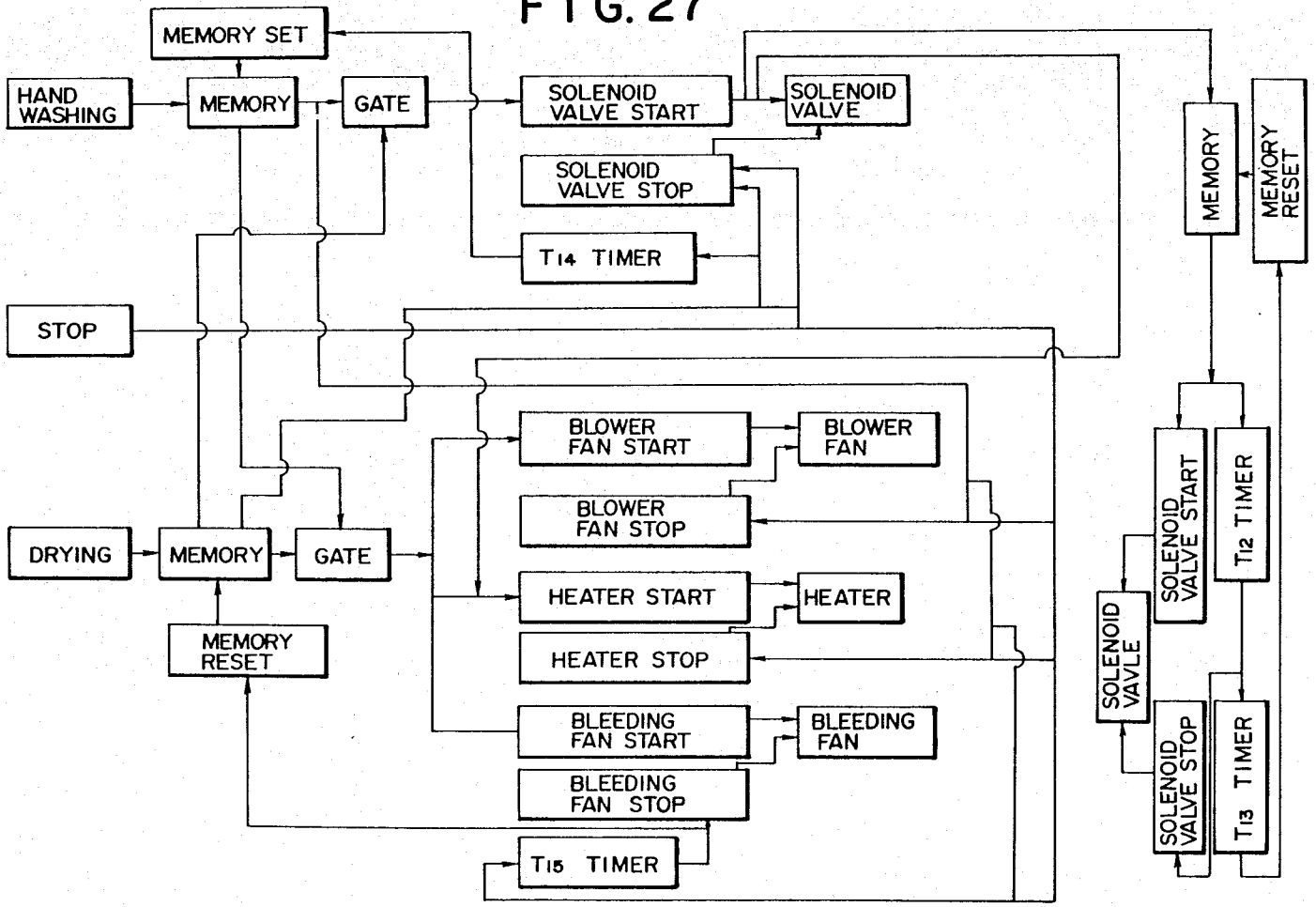
FIG. 27 is a flow chart for use in performing manual control.

The operating panel (27) is arranged at the side position of the hand washing bowl (c) at the rear wall ($A_8$) of the unit room (A). The operating panel; (27) is provided with a hand washing switch (27*a*) and a drying switch (27*b*) of the push-button type, light emitting diodes (27*c*), (27*d*) indicating the input condition of the switches, as shown in FIG. 23, and it is similarly provided with a stop switch (27*e*) of the push button type and with light emitting diodes (27*f*0, (27*g*) for displaying either automatic control or manual control and for indicating its operation, and further it is electrically connected to the control part (26).

Operation of the hand washing bowl (c) during hand washing is performed with reference to the time chart and the flow chart shown in FIGS. 24 to 27.

At first, in the case of an automatic control operation, when the user puts his hands into the hand washing bowl (c), the sensing part (25) detects the hands and sends the sensed signal to the control part (26). Input of a sensing signal to the control part (26) is only the first time of the inputting operation, and the sensed signals outputted subsequently to the first input time are prohibited from being input to the control part (26).

When a sensed signal is inputted to the control part (26), the solenoid valve (21*c*) for the hand washing water injection device (21) is opened for a desired period of time, for example, 10 seconds, under instructions from the control part (26), and the cleaning water for washing hands is injected from the water injection nozzle (21*a*). The solenoid valve (22*c*) for the bowl cleaning device (22) is opened simultaneously with the injection of the cleaning water from the water injection nozzle (21*a*) and then cleaning in the bowl (c) is started.

Time of opening of the solenoid valve (22*c*) is for one second, the solenoid valve (22*c*) is closed after this valve opening time is elapsed and the valve is then opened again after six seconds. Such periodic opening and closing of the solenoid valve (22*c*) is repeated several times during a hand washing time. Valve opening and closing times of the solenoid valve (22*c*) are counted by a timer at the control part (26), and the solenoid valve (22*c*) is opened or closed for a specified period of time at the control part (26).

Thus, a proper amount of cleaning water is supplied continuously into the bowl (c3) of hand washing bowl (c) until completion of hand washing action under periodic opening and closing operation of the solenoid valve (22*c*), and the sewage generated after hand washing action is discharged out of the hand washing bowl (c) and out of unit room (A) without remaining in the bowl (c).

After the hand washing and cleaning of the bowl (c3) are carried out, the hot air generating device (23) and air bleeding device (24) simultaneously start their operation after a desired time, for example, after 5 seconds is elapsed and then the hand drying and the air bleeding of the bowl part (c3) are carried out. The reason why a delay time is effected between starting operation of the hot air heater (23) and the air bleeding device (24) and stopping operation of the hand washing water injection device (21) and the bowl cleaning device (22) is that the cleaning water or sewage remaining in the bowl part (c3) is prevented from being splashed out of the bowl part (c3) with hot air produced from the hot air heater (23), and the air bleeding device may not be badly affected by the suction of the cleaning water into the air bleeding device.

The hot air heater (23) is operated such that air is heated during its passage through ceramic heater (235*c*) under rotation of the blower fan (233*c*) in the hot air generating machine (23*c*), and hot air is blown from the blowing nozzle (23*a*), struck against the hands to dry them. The ceramic heater (235*c*) is already started to heat when the sensed signal is inputted to the control part (26), and the hot air may instantly be fed by the blower fan (233*c*) when the drying operation is started.

The air bleeding device (24) is operated such that the bowl part (c3) is suctioned through the air bleeding passage (24*a*) under rotation of the forced air bleeding fan (24*c*), the operating time of the fan (24*c*) is counted by a timer at the control part (26), the fan (24*c*) is operated within a specified period of time at the control part (26) and then its operation is stopped after a desired delay time, for example, 5 seconds, has elapsed after the operation of the hot air generating device (23) is stopped. The reason why this delay time is provided consists in the fact that dusts such as waste matter produced by scrubbing of hands after drying is discharged out of the bowl part (c3) without remaining therein.

In cases where the automatic control is changed over to a manual control the stop pushbutton switch (27*e*) at the operating panel (27) is depressed, and the operation performed under an automatic control is stopped and reset to its initial condition, and thereafter either the hand washing switch (27*a*) or the drying switch (27*b*) is depressed to change-over from automatic control to manual control. Even if both the hand washing switch (27*a*) and the drying switch (27*a* ) are depressed during the automatic control operation, input is not received at the control part (26).

When the hand washing switch (27*a*) is depressed, both hand washing water injection device (21) and bowl cleaning device (22) are simultaneously started to operate in the same manner as the automatic control so as to perform both cleaning of hands and bowl part (c3). In order to stop the water injection of cleaning water after the hand cleaning is performed for a specified period of time, either the stop switch (27*a*) or the drying switch (27*b*) is depressed. When the drying switch (27*b*) is depressed, the hot air heater (23) and the air bleeding device (24) are started to operate with a desired time delay in the same manner as that of the automatic control after the injection of cleaning water is stopped, and a change-over from the hand washing operation to the drying operation is performed.

In turn, when the drying switch (27*b*) is depressed, the hands can be dried for a desired period of time under operation of the hot air heater (23) in the same manner as above. In order to stop the drying operation, either the stop switch (27*e*) or the hand washing switch (27*a*) is depressed, and when the hand washing switch (27*a*) is depressed, the operation is changed-over to the hand cleaning operation with a delay time in the same manner as that of the automatic control.

Figure 28:
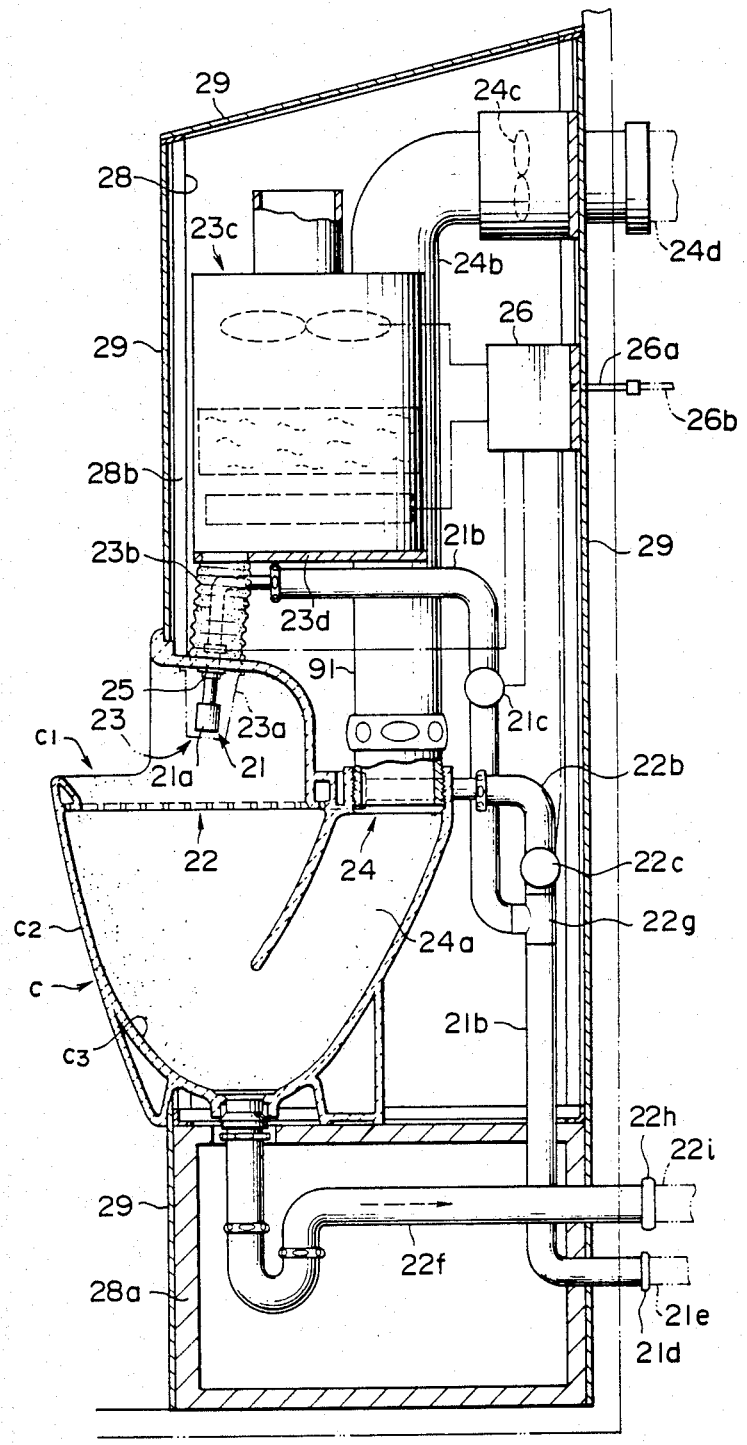
FIGS. 28 and 29 are longitudinal side elevations, in section for showing another preferred embodiment of a hand washing bowl.
Figure 29:
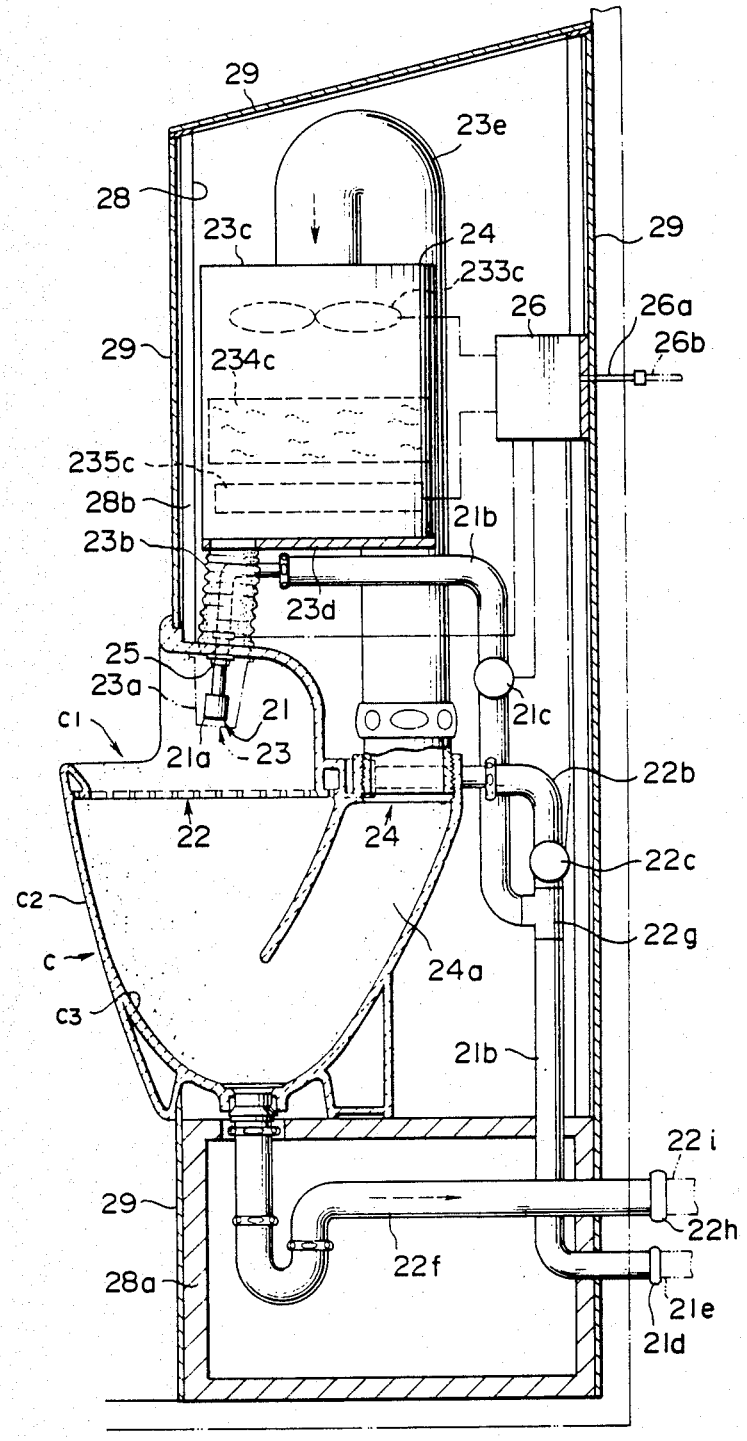

The system shown in FIGS. 28 and 29 illustrates another preferred embodiment of the toilet bowl (b), respectively.

The system shown in FIG. 28 is made such that fixing frames (28) are integrally assembled and formed from the bottom part of the hand washing bowl (c) to the upper part thereof through a rear part, and the toilet cleaning water injection device (21), bowl cleaning device (22), hot air heater (23), the functioning part of air bleeding device (24), and the control part (26), are fixed and arranged in the fixing frames (28), and at the same time a cover panel (29) is fixed over the fixing frames (28), thereby covering the functioning part of each of the devices and the control part to make a unified device.

The fixing frames (28) are comprised of a mounting block (28*a*) and a frame (28*b*) formed in a longitudinal box-like shape and facing upwardly from the mounting block (28*a*), hand washing bowl (c) is mounted and fixed on the mounting block (28*a*), a front opening (c1) of the hand washing bowl (c) and a front wall (c2) around the opening project out of the cover panel (29), and at the same time a code (26*a*) pulled out of the control part (26) can be connected to a power supply code (26*b*) arranged outside of the cover panel (26*b*).

The functioning part of the toilet cleaning water injection device (21) corresponds to the water supplying pipe (21*b*) and the solenoid valve (21*c*) except for the water injection nozzle (21*a*), and a base end of the water supplying pipe (21*b*) is passed through the cover panel (29) and projected outwardly and can be connected to the main water supplying pipe (21*e*) through a connector (21*d*).

The functioning part of the bowl cleaning device (22) corresponds to the water supplying pipe (22*b*) and the solenoid valve (22*c*), and a base end of the water supplying pipe (22*b*) is connected to the midway part of the water supplying pipe (21*b*) of the toilet cleaning water injection device (21) through a branch pipe (22*b*); thereby cleaning water is supplied.

A base end of the drain pipe (22*f*) to be connected to the hand washing bowl (c) is also passed through the cover panel (29) in the same manner as that of the water supplying pipe (21*b*), is projected outwardly and can be connected to the main drain pipe (22*i*) through a connector (22*h*).

The functioning part of the hot air heater (23) corresponds to a flexible pipe (23*b*) and a hot air generating machine (23*c*) except for a blowing nozzle (23*a*), and the hot air generating machine (23*c*) is mounted and fixed on a mounting plate (32*d*) arranged in the fixing frames (28).

The functioning part of the air bleeding device (24) comprises air bleeding pipe (24*b*) and a forced air bleeding fan (24*c*), and a base end of the air bleeding pipe (24*b*) is passed through the cover panel (29) and projected outwardly, and can be connected to the main air bleeding pipe (24*d*).

Figure 22:
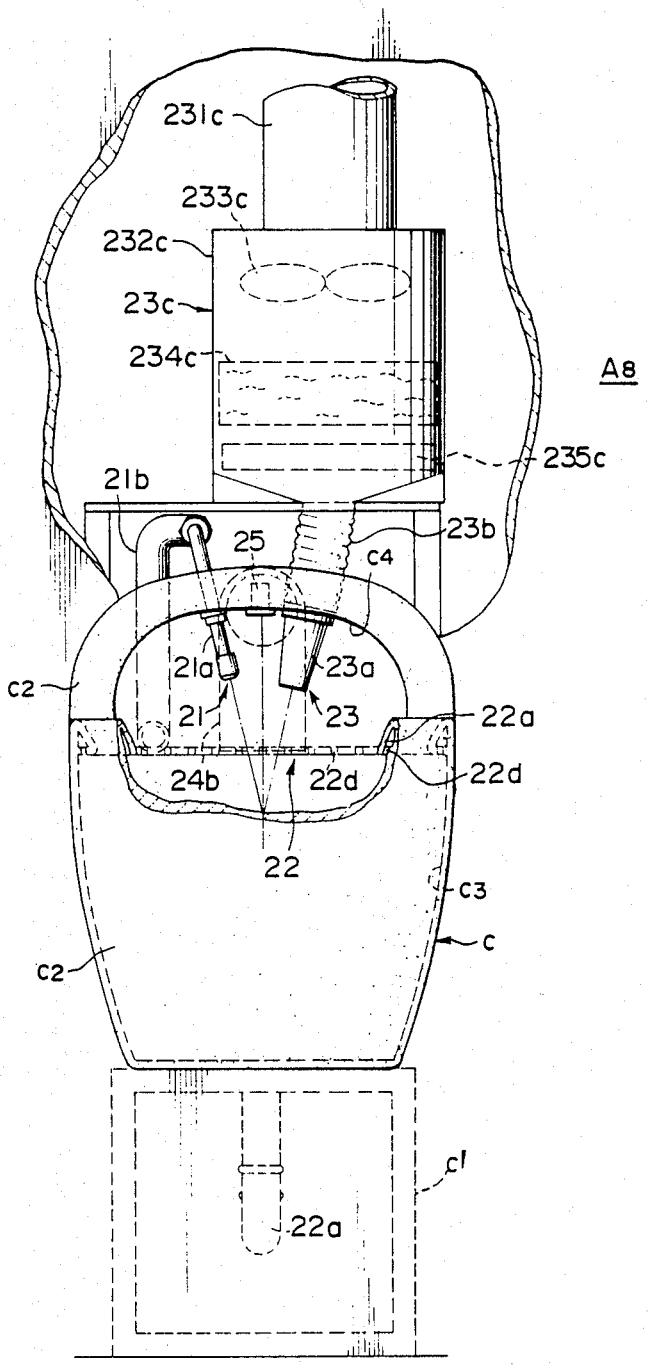
FIG. 22 is a front elevational view of FIG. 21.

Therefore, the system shown in FIG. 28 is completed in its work on site by a mere connection of a power supply code (26*b*), a main water supplying pipe (21*e*), a main drain pipe (22*i*) and a main air bleeding pipe (24*d*), and it does not require any troublesome operation in which the functioning parts of each of the devices and the control part (26) are separately mounted they must then be connected to each other as shown in FIGS. 21 and 22, resulting in mounting work becoming simple and convenient.

In turn, the system shown in FIG. 29 is made such that an hot air generating machine (23*c*) of a hot air heater (23) and an air bleeding passage (24*a*) formed adjacent to the rear part of the bowl part (c3) are connected by a suction and air bleeding pipe (23*e*). The air fed through the suction and air bleeding pipe (23*e*) from within the bowl part (c3) under rotation of the blower fan (233*c*) of the hot air generating machine (23*c*) is heated while it is passed through the ceramic heater (235*c*), and then the hot air is blown from the blowing nozzle (23*a*) to dry the hands and at the same time dust, such as waste matters generated during scrubbing of both hands while a drying operation is performed, are suctioned and then removed while they are passed through the air filter (234*c*), and they are then circulated.

Figure 30:
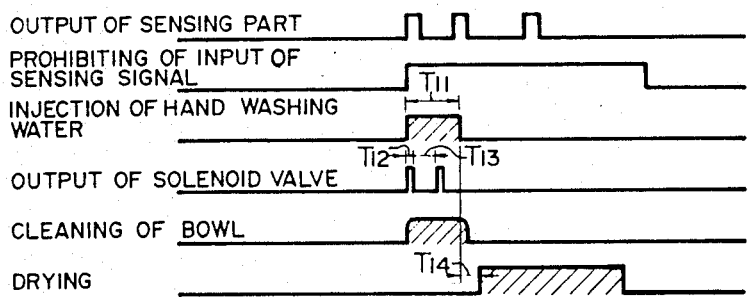
Figure 32:
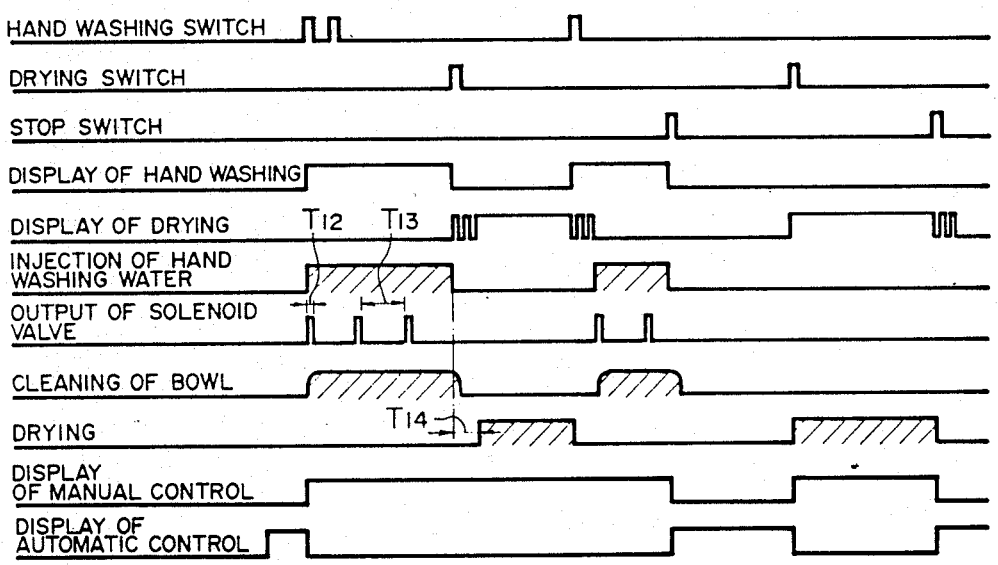
FIG. 32 is a time chart for use in performing manual control.
Figure 31:
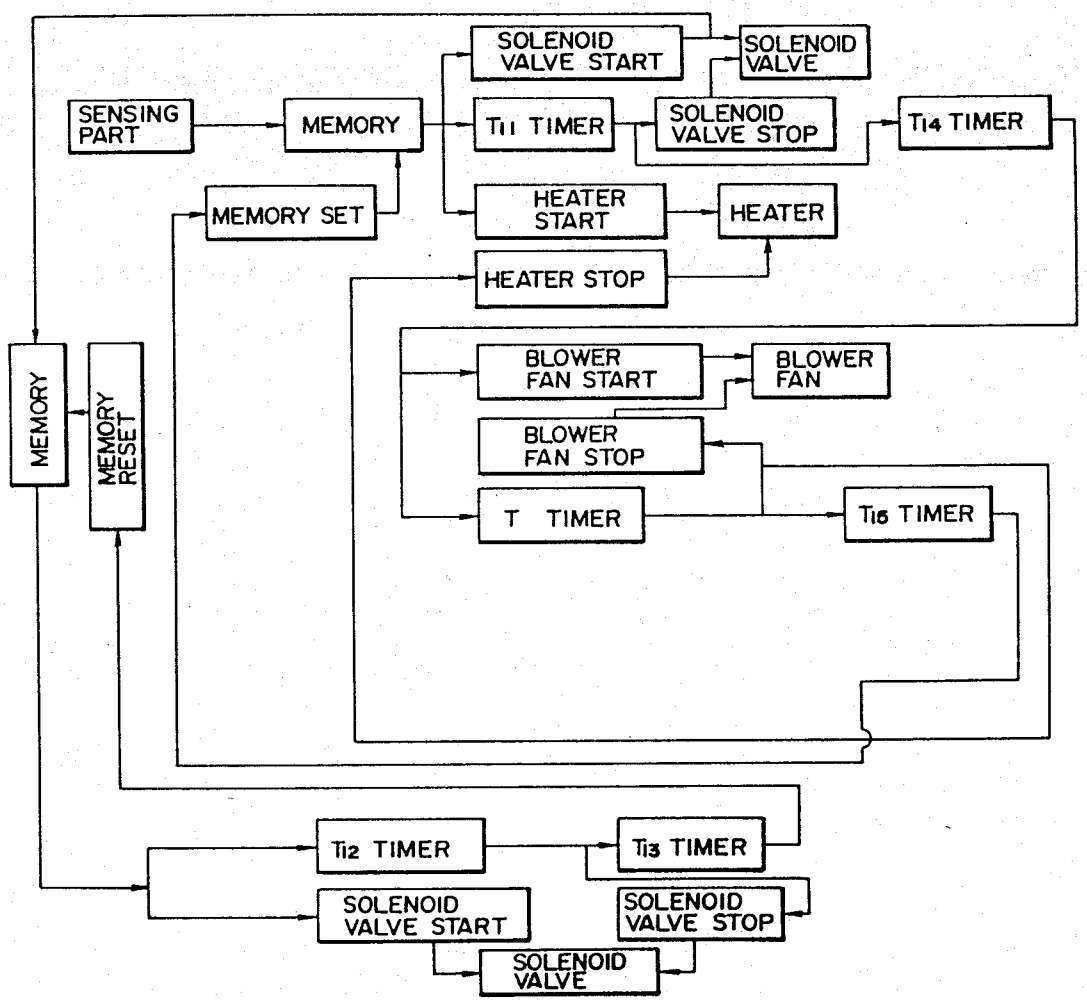
FIG. 31 is a flow chart for use in performing automatic control.
Figure 33:
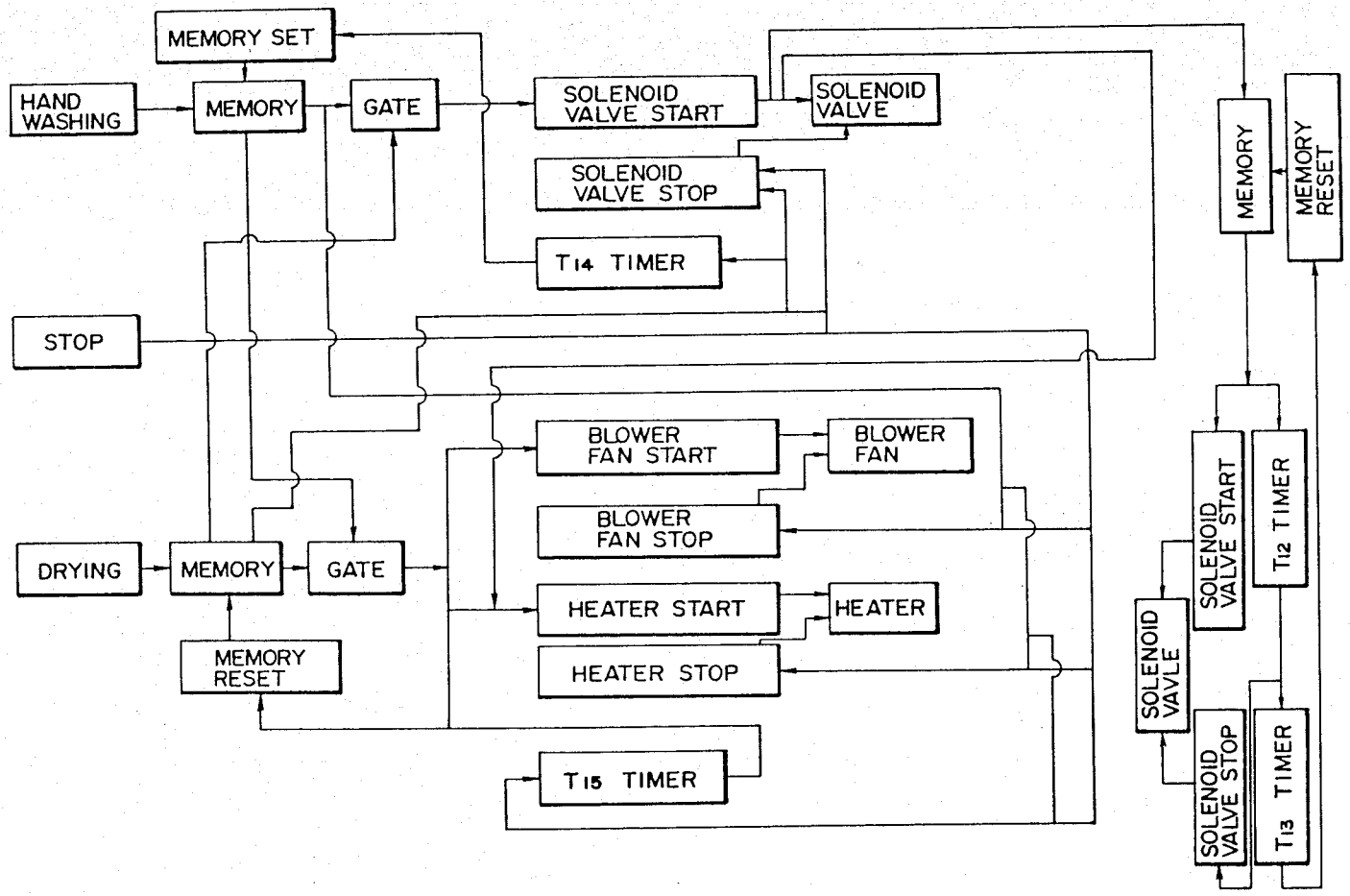
FIG. 33 is a flow chart for use in performing manual control.

Operation of the automatic control, in the case of hand washing at the hand washing bowl (c) shown in FIG. 29, is carried out with reference to the time chart and the flow chart of FIGS. 30 and 31, during performance of a manual control, and the operation is performed with reference to the time chart and the flow chart of FIGS. 32 and 33.

Therefore, the system shown in FIG. 29 can be installed more easily than that of FIG. 28 due to the fact that the air bleeding device and the main air bleeding pipe are not required to have a connection on site.

Further, although the present preferred embodiments show that the toilet bowls (a) and (b) and the hand washing bowl (c) are installed in the unit room (A), it is not necessarily required to install three units (a), (b) and (c) and for example, two units of toilet bowls (a) and (b) or two units of toilet bowl (b) and the hand washing bowl (c) may be installed.

What is claimed is:

1. A sanitary facility room adapted to be placed within a clean room, said sanitary facility room comprising:

(a) an enclosure including a plurality of upstanding vertical walls, a floor, and a ceiling;

(b) at least one toilet apparatus, said toilet apparatus including means for sensing the presence of a human body using said toilet apparatus, a toilet control device operable in response to signals emitted by said sensing means, and means for supplying water to the interior of said toilet apparatus, said control device comprising means for controlling the amount of clean water supplied to the interior of said toilet apparatus, said means for supplying water comprising means for forming a film of water along an interior surface of said toilet apparatus; and (c) means for cleaning the hands of said human body, said cleaning means comprising means for sensing the presence of hands of said human allong the interior of a bowl forming part of said cleaning means, a whasing control device operable in response to a signal sent to it by said hands sensing means, means for supplying water to the interior surface of said bowl and for forming a water film along said interior bowl surface, wherein said bowl washing control device comprises means for controlling the water supplied to said interior surface of said bowl by said bowl water supply means, wherein said enclosure, said toilet apparatus, and said cleaning means together comprise means for permitting a user to utilize said toilet apparatus and said cleaning means without touching any object within said sanitary facility room.

2. A sanitary facility room in accordance with claim 1 wherein said toilet apparatus comprises a toilet bowl having a seat on which a user is adapted to sit.

3. A sanitary facility room in accordance with claim 2 wherein said means for supplying water to the interior of said toilet apparatus comprises means for supplying water to said toilet bowl prior to use by said human and means for supplying water to the interior surface of said toilet bowl after said means for sensing said human body ceases sensing the presence of said body on said toilet apparatus.

4. A sanitary facility room in accordance with claim 2 wherein said toilet bowl comprises an air bleeding device including means for discharging odorous air from the interior of said toilet bowl, wherein said body presence sensing means and said toilet apparatus control device comprise means for controlling the operation of said air bleeding device.

5. A sanitary facility room in accordance with claim 4 wherein said air bleeding device comprises means for discharging air from the interior of said bowl from a time when said body presence sensing means detects the presence of a human body on said toilet bowl until after a predetermined time interval has elapsed after said sensing has ceased.

6. A sanitary facility room in accordance with claim 2 wherein said toilet bowl further comprises means for cleaning and drying a human body part positioned within said toilet bowl.

7. A sanitary facility room in accordance with claim 6 wherein said hands sensing means comprises means for controlling the operation of said cleaning and drying means.

8. A sanitary facility room in accordance with claim 7 wherein said cleaning means comprises means for washing said body part positioned within said toilet bowl and further comprises a bidet, said drying means comprising a dryer for drying said part of said human body positioned within said toilet bowl.

9. A sanitary facility room in accordance with claim 8 wherein said body sensing means comprises means for first initiating cleaning of the interior of said toilet bowl, for then cleaning said body part with said bidet, for then drying said body part with said dryer, and for then ceasing said cleaning and drying operation.

10. A sanitary facility room in accordance with claim 2 further comprising means for removing odor from the interior of said toilet bowl with a bleeding device for a period from a time when said body sensing means detects the presence of a human body on said toilet bowl and for a predetermined time period after said body sensing means no longer detects such presence, a cleaning device and a drying device for cleaning a part of a human body positioned within the interior of said toilet bowl, said cleaning and drying devices comprising means for first cleaning a part of said human body in response to a signal received from said body sensing means, then cleaning said body part with a bidet, thereafter drying said body part, and finally stopping said cleaning and drying operations.

11. A sanitary facility room in accordance with claim 10 further comprising a framework which is adapted to be attached integrally to a rear portion of said toilet bowl, and wherein said means for supplying water to said toilet bowl, said air bleeding device, a portion of said drying device, a drain, and said toilet control device are fixedly attached within said frame, said frame including a cover panel attached thereto.

12. A sanitary facility room in accordance with claim 2 further comprising means for intermittently operating both of said water supply means.

13. A sanitary facility room in accordance with claim 1 further comprising a framework which is adapted to be integrally assembled and attached to a rear portion of said at least one toilet apparatus, wherein said toilet control device and said means for supplying water to said toilet apparatus are positioned within said framework, said framework further comprising a cover panel attached to framing members forming a portion of said framework, said cover comprising means for covering at least a portion of said toilet apparatus water supply means and said toilet control device.

14. A sanitary facility room in accordance with claim 1 wherein said means for cleaning the hands of a user comprises a sink incorporating a hand washing bowl.

15. A sanitary facility room in accordance with claim 14 wherein said hand cleaning means further comprises a hot air heater for drying the hands of a user, said hand presence sensing means comprising means for selectively operating said hot air heater after said cleaning device water supply means has been activated by said hand presence sensing means.

16. A sanitary facility room in accordance with claim 15 wherein said hand cleaning means further comprise an air bleeding device comprising means for discharging air from the interior of said hand washing bowl, said hand sensing means comprising means for operating said air bleeding device simultaneously with said hot air heater.

17. A sanitary facility room in accordance with claim 15 wherein said means for supplying water to said hand cleaning means comprise means for supplying cleaning water to the interior of said washing bowl, means for washing the interior of said bowl, and means for supplying clean water to wash the hands of a user.

18. A sanitary facility room in accordance with claim 17 comprising means for stopping operation of said cleaning means wter supply means during operation of said hot air heater.

19. A sanitary facility room in accordance with claim 18 further comprising selectively operable manual switches for controlling said cleaning means water supply means and said hot air heater.

20. A sanitary facility room in accordance with claim 19 further comprising means for initiating a drying operation of the hands of the user after a predetermined period of time has elapsed after a hand washing operation has been completed.

21. A sanitary facility room in accordance with claim 18, with said hot air heater further comprises a discharge side and a filter positioned adjacent to said discharge side.

22. A sanitary facility room in accordance with claim 21 further comprising a framework integrally attached to a rear portion of said washing bowl, said framework being positioned below said washing bowl, above said washing bowl, and behind said washing bowl, said framework including a cover and comprising means for housing said water supply means for said cleaning means, said hot air heater, at least a portion of said air bleeding device for said washing bowl, and said cleaning means control device, wherein said water supply means for said cleaning means, said hot air heater, and said portion of said air bleeding device for said washing bowl are attached to said framework, said cover panel being adapted to cover said elements within said framework.

23. A sanitary facility room in accordance with claim 1 wherein said toilet apparatus comprises a urinal.

24. A sanitary facility room in accordance with claim 23 wherein said means for supplying water to said toilet apparatus comprises means for supplying a water film to the interior of said urinal during a period starting prior to the time when said user uses said urinal until a predetermined time period has elapsed after said user has finished using said urinal.

25. A sanitary facility room in accordance with 24 further comprising a framework attached to said urinal for enclosing said water supply device for said urinal, said body sensing means, and means for controlling the operation of said water supply device for said urinal.

26. A sanitary facility room in accordance with claim 1 wherein said at least one toilet apparatus comprises a toilet bowl and a urinal, and wherein said cleaning means comprises a sink having a bowl.

27. A sanitary facility room in accordance with claim 26 wherein said sink includes means for sensing the presence of the hands of a user within said sink bowl for at least a predetermined period, said urinal comprises means for detecting the presence of a user adjacent thereto for at least a predetermined period, and said toilet bowl comprises means for detecting the presence of the body of a user within said toilet bowl for at least a predetermined period.

28. A sanitary facility room in accordance with claim 27 wherein said each of said detecting means comprises a photocell angled downwardly.

29. A sanitary facility room in accordance with claim 28 wherein each of said sensing means comprises means which sense the presence of at least part of a human body and send a signal to respective control device only after said human body part has been sensed for at least three seconds.

30. A sanitary facility room in accordance with claim 1 further comprising means for conducting air outwardly from said room through said floor, means for circulating said air from below said floor to a location above said ceiling, means for filtering said air above said ceiling, and means for thereafter conducting said filtered air back into the interior of said sanitary facility room.

31. A sanitary facility room adapted to be positioned within a clean room, said sanitary facility room comprising:

(a) an enclosure defined by a plurality of upstanding walls, a floor positioned below said walls, and a ceiling positioned above said walls;

(b) at least one toilet apparatus for operation by a user, said at least one toilet apparatus comprising means for sensing the presence of a user of said toilet apparatus after said user has been present at said apparatus for a predetermined period of time, means for cleaning the interior of said toilet apparatus from a period starting prior to use of said apparatus by a user and extending until a predetermined period has elapsed after said user is no longer positioned on said apparatus, said cleaning means and said sensing means together comprising means for operating said toilet apparatus without the hands of said user wherein said cleaning means comprises means for forming a film of water along an interior surface of said toilet apparatus;

(c) at least one sink apparatus, said at least one sink apparatus comprising a washing bowl and means for sensing the presence of the hands of a user within the interior of said bowl, said sink apparatus further comprising means for washing said hands and means for drying said hands, and means for forming a water film along said washing bowl interior said hand sensing means comprising means for activating said continuous film formation along the interior of said sink bowl and for washing and drying the hands of a user in a controlled fashion, wherein said hand sensing means, said hand washing means, and said hand drying means comprise means for permitting handless operation of said sink apparatus by a user.

* * * * *

UNITED STATES PATENT AND TRADEMARK OFFICE

CERTIFICATE OF CORRECTION

PATENT NO. : 4,692,951

DATED : September 15, 1987

INVENTOR(S) : Masaru TAKI et al.

It is certified that error appears in the above-identified patent and that said Letters Patent is hereby corrected as shown below:

At column 1, line 24 of the printed patent, cahnge "relative by" to ---relatively---.
At column 1, line 29 of the printed patent, insert ---of--- after "in the case".
At column 2, line 61 of the printed patent, delete "of" after "chart".
At column 3, line 15 of the printed patent, change "FIG. 20" to ---FIG. 30---.
At column 3, line 46 of the printed patent, change "and," to ---, and---.
At column 3, line 60 of the printed patent, change "midway in of" to ---midway in---.
At column 4, line 12 of the printed patent, change "(Al)" to ---(al)---.
At column 4, line 58 of the printed patent, insert --- and ---before "odor".
At column 5, line 43 of the printed patent, delete "the" after "from".
At column 5, line 63 of the printed patent, change "tree" to ---three---.
At column 6, line 43 of the printed patent, change "begin" to ---begins---.
At column 7, line 63 of the printed patent, delete "to" after "comprises".
At column 8, line 24 of the printed patent, change "the" to ---The---.
At column 8, line 30 of the printed patent, delete "and".

UNITED STATES PATENT AND TRADEMARK OFFICE

CERTIFICATE OF CORRECTION

PATENT NO. : 4,692,951

DATED : September 15, 1987

INVENTOR(S) : Masaru TAKI et al.

It is certified that error appears in the above-identified patent and that said Letters Patent is hereby corrected as shown below:

At column 8, line 31 of the printed patent, change "the" (second occurrence) to ---and---.
At column 9, line 50 of the printed patent, insert ---and--- after "(15)".
At column 9, line 60 of the printed patent, change "supplying" to ---supply---.
At column 10, line 12 of the printed patent, change "presense" to ---presence---.
At column 10, line 36 of the printed patent, delete "and".
At column 10, line 37 of the printed patent, insert --and ---after "(c3),".
At column 10, line 43 of the printed patent, change "wter" to ---water---.
At column 10, line 54 of the printed patent, change "in its width direction" to ---along its width---.
At column 10, line 56 of the printed patent, delete "and".
At column 10, line 57 of the printed patent, insert ---and--- before "the hot air".
At column 10, line 62 of the printed patent, insert a "," before "and".
At column 11, line 30 of the printed patent, insert ---at--- before "an intermediate".
At column 11, line 31 of the printed patent, delete "at" before "and as".
At column 12, line 12 of the printed patent, delete "," after "for example".

UNITED STATES PATENT AND TRADEMARK OFFICE

CERTIFICATE OF CORRECTION

PATENT NO. : 4,692,951

DATED : September 15, 1987

INVENTOR(S) : Masaru TAKI et al.

It is certified that error appears in the above-identified patent and that said Letters Patent is hereby corrected as shown below:

At column 12, line 58 of the printed patent, change "is" to ---has---.
At column 14, line 30 of the printed patent, change "projected" to ---projects---.
At column 14, line 38 of the printed patent, insert ---;--- after "mounted".
At column 14, line 43 of the printed patent, change "an hot" to ---a hot---.
At column 15, line 28 (claim 1, line 20) of the printed patent, change "allong" to ---along---.
At column 15, line 31 (claim 1, line 22) of the printed patent, change "whasing" to ---washing---.
At column 17, line 2 (claim 16, line 2) of the printed patent, change "comprise" to ---comprises---.

Signed and Sealed this

Twenty-third Day of August, 1988

*Attest:*

DONALD J. QUIGG

*Attesting Officer*

*Commissioner of Patents and Trademarks*